US005557367A

United States Patent [19]

Yang et al.

[11] Patent Number: 5,557,367

[45] Date of Patent: Sep. 17, 1996

[54] METHOD AND APPARATUS FOR OPTIMIZING SCHEDULING IN IMAGING DEVICES

[75] Inventors: Ming Yang, Fairport; Injae Choi, Webster; Tsai C. Soong, Penfield, all of N.Y.

[73] Assignee: Xerox Corporation, Stamford, Conn.

[21] Appl. No.: 411,175

[22] Filed: Mar. 27, 1995

[51] Int. Cl.[6] ..... G03G 21/00

[52] U.S. Cl. ..... 355/202; 355/204; 355/208; 355/308

[58] Field of Search ..... 355/200, 202, 355/204, 208, 210, 308, 309, 313, 316, 317, 318, 319, 320, 321; 358/296, 300

[56] References Cited

U.S. PATENT DOCUMENTS

| | | | |
|---|---|---|---|
| 5,095,342 | 3/1992 | Farrell et al. . | |
| 5,095,369 | 3/1992 | Oritz et al. | 358/296 |
| 5,130,750 | 7/1992 | Rabb . | |
| 5,159,395 | 10/1992 | Farrell et al. . | |
| 5,184,185 | 2/1993 | Rasmussen et al. . | |
| 5,260,758 | 11/1993 | Stemmle . | |
| 5,281,998 | 1/1994 | Douglas et al. | 355/202 |
| 5,287,194 | 2/1994 | Lobiondo | 358/296 |
| 5,305,056 | 4/1994 | Salgado et al. | 355/202 |
| 5,337,135 | 8/1994 | Malachowski et al. . | |
| 5,384,620 | 1/1995 | Ebner et al. | 355/202 |
| 5,504,568 | 4/1996 | Saraswat et al. . | |

OTHER PUBLICATIONS

Covert, *Xerox Disclosure Journal*, "Throughput Increase of Simplex–Duplex Intermix Jobs", vol. 18 No. 4 Jul./Aug. 1993, pp. 431–433.

*Primary Examiner*—Sandra L. Brase
*Attorney, Agent, or Firm*—Oliff & Berridge

[57] ABSTRACT

A method of scheduling a job in an imaging system includes detecting criteria of the job, determining applicable constraints based upon one or more of the criteria, inputs entered into the imaging system and/or operating the imaging system to output the job such that the constraints are satisfied, thereby maximizing output. Each job includes a plurality of images to be processed by the imaging system, which includes at least one imaging device. As a result, the scheduling of jobs is carried out in an effective and efficient manner.

37 Claims, 14 Drawing Sheets

METHOD AND APPARATUS FOR OPTIMIZING SCHEDULING IN IMAGING DEVICES

BACKGROUND OF THE INVENTION

The present invention relates to scheduling the processing of images in imaging devices, and in particular, to a method and an apparatus for providing an optimized schedule according to which a plurality of images are processed to maximize a productivity value.

"Imaging" or "marking," as used alternatively herein, is the entire process of putting an image (from a digital or an analog source) onto a medium, e.g., paper or another medium. In the case of a paper medium, the image can be permanently fixed to the paper by fusing, drying or other known methods. The present invention applies to any imaging device or system of devices in which the images are made electronically, including, e.g., electronic copiers and printers.

An imaging device typically includes a copy sheet paper path through which sheets or pages of the copy medium (e.g., plain paper) that are to receive an image are conveyed and imaged. The process of inserting copy sheets into the copy sheet paper path sequentially and controlling the movement of the copy sheets through the paper path to receive an image on one or both sides is referred to as "scheduling." A group of one or more desired images to be scheduled and printed is a "job."

The copy sheet paper path usually includes positions (i.e., pitches) for more than one copy sheet such that several sheets are sequentially processed at any given time. The copy sheets are printed as they circulate one or more times through the copy sheet paper path adjacent a marking station. Copy sheets that are printed on only one side (i.e., simplex copy sheets) in a single color usually pass through the copy sheet paper path once. Copy sheets that are printed on both sides (i.e., duplex sheets) usually pass through the copy sheet paper two or more times, although receiving images on both sides in a single pass is also possible. In addition to printing duplex images, multipass printing may be used to print color or highlighted images on one or both sides of the copy sheet. Conventional color printing, e.g., requires four passes through the transfer nip, i.e., one pass to transfer each of the four primary colors (black, magenta, yellow, and cyan). Accordingly, a scheduling routine must account for whether the output is desired in one of simplex, duplex or mixed formats, as well as whether the output is in color, in black and white or highlighted. Furthermore, because certain imaging operations require more processing time than others, e.g., duplex sheets may require more time to process than simplex sheets, an appropriate scheduler must also ensure that the sheets are output according to the desired sequence.

Other criteria also affect scheduling. For instance, a user may desire two or more sheets of the job to be stapled together or collated in a certain order. The user may desire to produce certain images on different sizes of copy stock. Certain images may need to be produced on orientation sensitive copy stock (e.g., paper having pre-punched holes along one of its edges). Each of these criteria, as well as others, imposes one or more constraints in scheduling the output of a job.

in addition, the construction and features, i.e., the architecture, of each imaging device imposes device-dependent constraints on scheduling. For example, the number of pitches of a photoreceptor and of a duplex loop portion of the paper path, the speed of the duplex loop and the conditions under which an imaging device resumes copying following a paper jam, each must be considered to provide a comprehensive scheduling routine. Consequently, providing a scheduling routine that accounts for all the criteria available to a user and satisfies both the image sequence and the device dependent (i.e., architectural) constraints is difficult.

As a result, each of the past efforts at scheduling focused on a specific type of imaging device, rather than the general class of imaging devices as a whole. Moreover, each conventional scheduling routine draws chiefly from empirical observations of various imaging sequences and procedures, rather than an analysis that primarily relies upon mathematical principles. Furthermore, the conventional scheduling routines, chiefly because of methodological differences and computation time limits, do not schedule each job directly based on the job in hand and a mathematical optimized minimum number of frames required to complete the job, but rather start each job based on experience and massage the tentative print schedule to yield an enhanced but imperfect result.

For example, U.S. Pat. Nos. 5,095,342 and 5,159,395 to Farrell et al. disclose methods of scheduling sheets in imaging devices having endless duplex paper path loops and dual mode duplex printing, respectively. U.S. Pat. No. 5,260,758 to Stemrole discloses a signature (i.e., an original typically having two or more pages per side) job copying system. U.S. Pat. No. 5,184,185 to Rasmussen discloses a method for scheduling duplex printing in which the gaps that occur between sheets of each set are selectively combined to minimize the number of required pitches. U.S. Pat. No. 5,130,750 to Rabb discloses cross-pitch scheduling of documents and copy sheets in an imaging device. U.S. Pat. No. 5,337,135 to Malachowski discloses a variable speed duplex drive for varying the rate at which sheets travel within the duplex loop so that the number of skipped pitches is reduced. Treating simplex sheets as simplex sheets under certain predetermined conditions to maximize the overall throughput of the imaging device is disclosed in an article by Covert in the Xerox Disclosure Journal, vol. 18, No. 4 (July/August 1993) at pp. 431–433. As illustrated by these examples, all of which are incorporated herein by reference, the conventional methods of scheduling jobs in an imaging device relate only to the specific constraints imposed by the architecture of that device.

Other constraint-based approaches to scheduling, such as forward scheduling and backward scheduling, have been suggested. These approaches differ from the present invention because they require preparing a tentative schedule of a first set based on constraint-based scheduling rules and then systematically constructing the remaining sets frame-by-frame either forwardly to get the second and third sets, etc., which is called the "forward method", or backwardly, taking the finished first set as the last set and construct the adjacent frames and sets in a backward manner up to the first set, which is called the "backward method." These approaches do not consider the whole print "job" in its entirety simultaneously in a mathematical optimization scheme. In other words, the present invention does not treat the first set, or any other set, with preference over the remaining sets. Rather, the scheduler according to the present invention treats all constraints equally, with few exceptions, and does not account for some architectural features first before accounting for others.

Moreover, the conventional methods of scheduling fail to address an important setting in which multiple imaging devices are used. In a modern print shop, for example, jobs are often divided into multiple tasks for processing in two or more imaging devices, each having particular capabilities and imposing certain constraints. The decision on how to divide the job into tasks, as well as the scheduling of each task, is carried out on an ad hoc basis. Therefore, in the case of an inexperienced user and/or a complicated job, the most efficient use of all the available imaging devices cannot be ensured.

One measure of the efficiency of an imaging device is its productivity. Productivity is defined as the actual number of pitches required in a job, in which a black-and-white simplex page is counted as one pitch, a full color page is counted as four, a duplex sheet is counted as having two pages, each page having one or four frames, divided by the actual number of required pitches necessary to complete the job. The actual number of required pitches usually exceeds the minimum number because of the skipped pitches necessary to conform to the constraints. In other words, to ensure that the images are output in the correct order, one or more skipped pitches may be scheduled following a previous image such that the previous image can be processed before the processing of a subsequent image is begun. As a result, productivity provides an efficiency measure by which the performance of imaging devices can be compared: an imaging device having a higher productivity for a particular job requires fewer pitches than an imaging device with a lower productivity. By maximizing the productivity of a particular imaging device, the processing time required to complete a job is minimized, and the throughput of the imaging device is maximized.

SUMMARY OF THE INVENTION

Accordingly, it is an object of the present invention to provide a method for scheduling jobs in an imaging device that maximizes its productivity.

It is another object to provide a method for scheduling that applies to all imaging devices generally. It is yet another object to provide a method for scheduling that allows tailoring a schedule to each specific job.

Still another object is to provide a method for scheduling that accounts for both the image sequence and device-dependent constraints of one or more imaging devices.

Accordingly, the method of scheduling a job (the job including a plurality of images to be processed) in an imaging system includes detecting criteria of the job, determining applicable constraints based upon one or more of the criteria, inputs entered into the system and/or the imaging device, and optimizing the imaging system to process the job such that each constraint is simultaneously satisfied.

Detecting the criteria of the job can include detecting user input. Determining the applicable constraints can include determining imaging device constraints and image sequence constraints.

In one embodiment, the imaging device includes a copy paper path having a duplex loop through which copy sheets circulate to a photoreceptor for imaging. The imaging device constraints include at least a number of pitches of the photoreceptor, each of the pitches being a position for one frame of the copy sheets. The imaging device constraints can also include a duplex loop length, the duplex loop length being a number of pitches in the duplex loop.

The image sequence constraints can include, for example: a page sequence constraint (which requires that a next pitch number of a last pass of a second page must exceed a previous pitch number of a last pass of a previous page); a set sequence constraint (which requires that a last page of a previous set is completed before a first page of a next set); an enhanced image constraint (which requires that each pass of an enhanced image is imaged on a same sheet); a single image constraint (which requires that each of the images occupies a distinct pitch on the photoreceptor); and a pitch number constraint (which requires that the pitch number is not less than one).

The set sequence constraint can also require, for example, that a number of reserved pitches follows a last pass of the the last page of the previous set before a first pass of a first page of a next set. The enhanced image constraint can also require, for example, that each pass is imaged by the photoreceptor when a pitch occupied by the same sheet is adjacent the photoreceptor.

The job can include images to be produced in duplex pages, i.e., pages having images on both sides. In the case of a duplex job, the image sequence constraints can include a side sequence constraint which requires that a first side of a duplex page must be processed before a second side of the duplex page. The imaging device can include a constraint-rate duplex loop, in which case the image sequence constraints can include a duplex loop paper speed constraint which requires the first side of the duplex sheet to travel through the duplex loop before the second side is processed.

The imaging device can include a variable rate duplex loop, in which case the image sequence constraints can include a duplex loop paper speed constraint which requires that a duplex page cannot travel faster than a maximum variable speed.

In one embodiment, a previous duplex sheet enters the duplex loop before a next duplex sheet, and the image sequence constraints include a duplex loop entry order constraint which requires that the first duplex sheet exits the duplex loop before the second duplex sheet. The image sequence constraints can also include a duplex loop paper limit constraint, which requires that a number of duplex sheets within the duplex loop not exceed a maximum duplex sheet number.

At least a plurality of the image sequence constraints can be expressed mathematically. Further, at least one of the image sequence constraints can be expressed as an inequality. Optimizing can include synchronizing the processing of a next simplex sheet with a previous duplex sheet such that the next simplex sheet does not interfere with the previous duplex sheet.

The step of detecting can include detecting an image designation for each of the plurality of images. The image designation can include a set number i, a page number j, a side number l and a pass number k. The set number is equal to a desired number of duplicates of an image. The page number is equal to a number of pages in each set. The side number is equal to a number of sides of each page. The pass number is equal to a number of passes required to process each side.

The step of scheduling can include determining solutions of simultaneous equations that represent the frames to arrange a proper sequence of the job. The step of scheduling can also include minimizing the number of skipped pitches required to fill the spaces between image pitches to conform to the applicable constraints. If a plurality of the constraints are in linear form in terms of the number of frames required, and a plurality of the resulting equations are in the form of linear inequality equations, the scheduling step can include linearly optimizing the equations. If the applicable constraints include at least one non-linear constraint, the step of scheduling can include solving the non-linear constraint mathematically. The non-linear constraint can be the single image constraint, which requires that each of the images occupies a distinct pitch on the photoreceptor. If the non-linear constraint is not included in the simultaneous linear equations that are solved by mathematical optimization, the non-linear constraint can be solved using a slack variable.

The step of scheduling can include disregarding the at least one non-linear constraint, determining which frames had been occupied by more than one image and reducing the multiple-occupancy frames mathematically until each frame exists in a one-to-one relationship with each image. The step of scheduling can include adding at least one slack variable constant to the inequality equations when the equations are transformed into equality equations. In this way, the integer value of the slack variable constant can be varied so that the number of multiple-occupancy frames is reduced. Further, the step of scheduling can include outputting an optimized sequence of frames in which images are transferred to copy sheets passing the nip of the photoreceptor in the order outputted.

The applicable constraints can include a copy sheet delay feature which specifies an interval between the processing of a first side of a copy sheet that travels through the duplex loop and a second side of the sheet, the interval being equal to a number of frames that separate the first side from the second side. Similarly, the applicable constraints can include a copy sheet delay feature at the end of the inverter path.

According to another embodiment of the present invention, a scheduler for scheduling a job in an imaging system includes at least one imaging device, the scheduler having a determining device and a controller. The determining device detects criteria of the job and determines constraints based on at least one of the criteria, inputs entered into the system and the at least one imaging device such that a productivity value is maximized. The controller controls the at least one imaging device to output the job in accordance with the productivity value determined by the determining device.

The scheduler can include an image sequence constraints memory that contains image sequence constraints that govern at least one of an absolute position and a relative position of the plurality of images to be processed. The inputs entered into the system can be entered by a user. The scheduler can also include an imaging device constraints memory which contains imaging device constraints. The imaging device constraints are operating parameters for each imaging device.

According to another embodiment of the present invention, the scheduler includes a synchronizer. The synchronizer has a delay device that synchronizes the processing of a next simplex sheet with the processing of a previous duplex sheet such that the next simplex sheet does not interfere with the previous duplex sheet. The imaging device can include a copy paper path that begins at a copy paper entry point, continues through a photoreceptor, and divides at a branch point into a simplex copy paper path and a duplex copy paper path. The simplex copy paper path extends from the branch point through a set of exit rollers to a copy paper exit point. The duplex copy paper path extends from the branch point to an inverter, from the inverter to a duplex loop and from the duplex loop to the set of exit rollers and the copy paper exit point. The synchronizer includes a delay device disposed adjacent the simplex copy paper path and between the branch point and the copy paper exit point. The delay device selectively decreases a speed at which a simplex copy sheet travels along the simplex copy paper path. If the simplex sheet follows a duplex sheet, the delay device operates to delay the simplex sheet so that the duplex sheet reaches the copy paper path exit point before the simplex sheet.

According to another embodiment of the invention, a synchronizer synchronizes the processing of a mixed simplex and duplex job in an imaging device. The imaging device has a copy paper path that begins at a copy paper entry point, continues through a photoreceptor, and divides at a branch point into a simplex copy paper path and a duplex copy paper path. The simplex copy paper path extends from the branch point through a set of exit rollers to a copy paper exit point. The duplex copy paper path extends from the branch point to an inverter, from the inverter to a duplex loop and from the duplex loop to the set of exit rollers and the copy paper exit point. The synchronizer includes a delay device disposed adjacent the simplex copy paper path and between the branch point and the copy paper exit point, the delay device selectively decreasing a speed at which a simplex copy sheet travels along the simplex copy paper path. If a simplex sheet follows a duplex sheet, the delay device operates to delay the simplex sheet so that the duplex sheet reaches the copy paper path exit point before the simplex sheet.

The delay device can include a first set of retiree rollers that are disposed adjacent the simplex copy paper path and controlled to rotate at a first retiree roller rate in a direction opposite a direction of travel of the simplex page. The first retime roller rate is sufficient to prevent the simplex sheet from intercepting the duplex sheet. The delay device can create an intercopy gap between a trailing edge of the duplex sheet and a leading edge of the simplex sheet. The intercopy gap can be less than a width of the simplex sheet. The intercopy gap can be less than a width of the simplex sheet, the width being a distance between the leading edge of the simplex sheet and a trailing edge of the simplex sheet. The synchronizer can include additional sets of retiree rollers disposed adjacent the simplex copy paper path and in a cooperative relationship with the first pair of retime rollers. The synchronizer selectively operates to decrease the speed at which the simplex page travels after a first side of the duplex page, and before a second side of the duplex page, is processed.

BRIEF DESCRIPTION OF THE DRAWINGS

A complete understanding of the present invention may be obtained by reference to the accompanying drawings, when considered in conjunction with the subsequent detailed description thereof, in which.

DETAILED DESCRIPTION OF PREFERRED EMBODIMENTS

Figure 1:
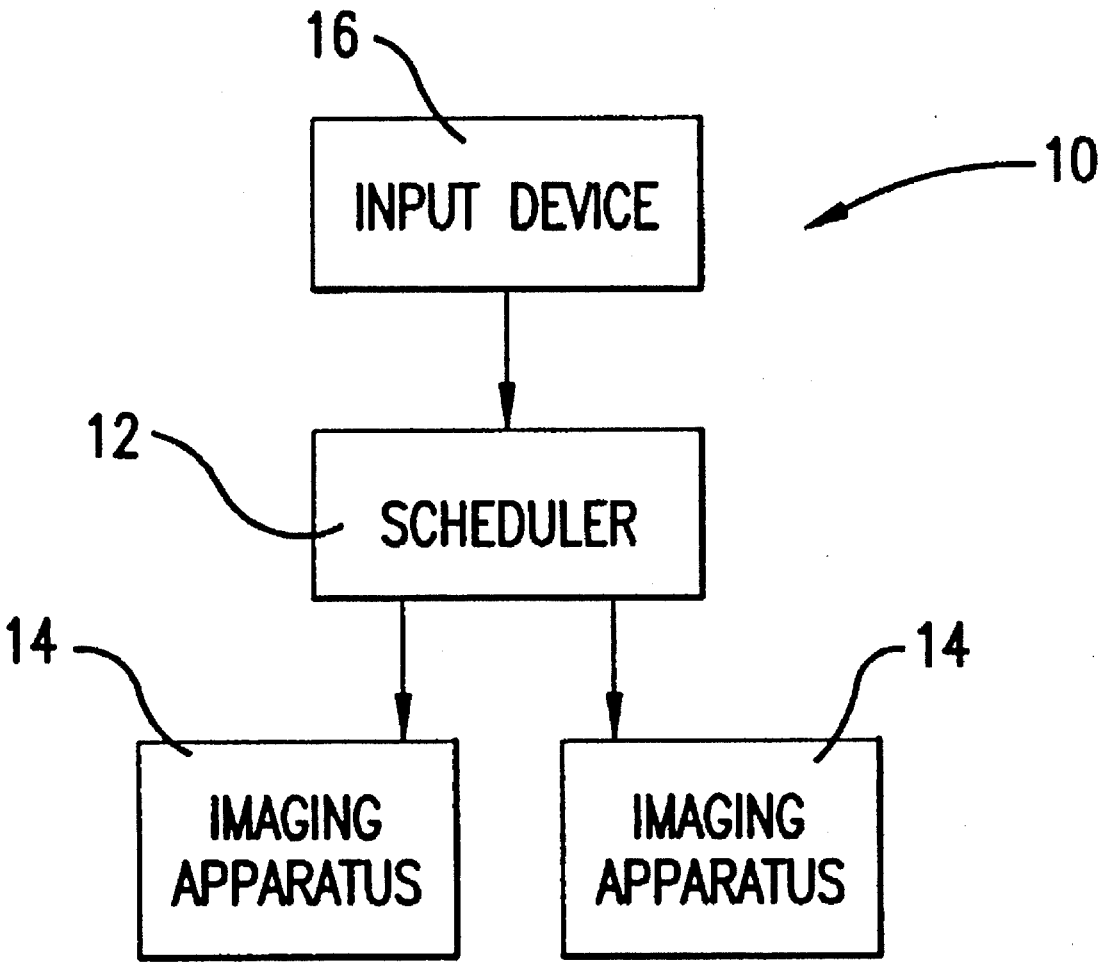
FIG. 1 is a schematic view showing an imaging system having a scheduler according to the present invention.

In FIG. 1, an imaging system 10 that includes a scheduler 12 according to the present invention is shown. The scheduler 12 is connected to at least one imaging device 14 and to an input device 16. The imaging device 14 may be a printer, photocopier or other suitable image finishing device. The input device 16 may be a keyboard, console or other suitable input device, including a memory storing device.

Figure 2:
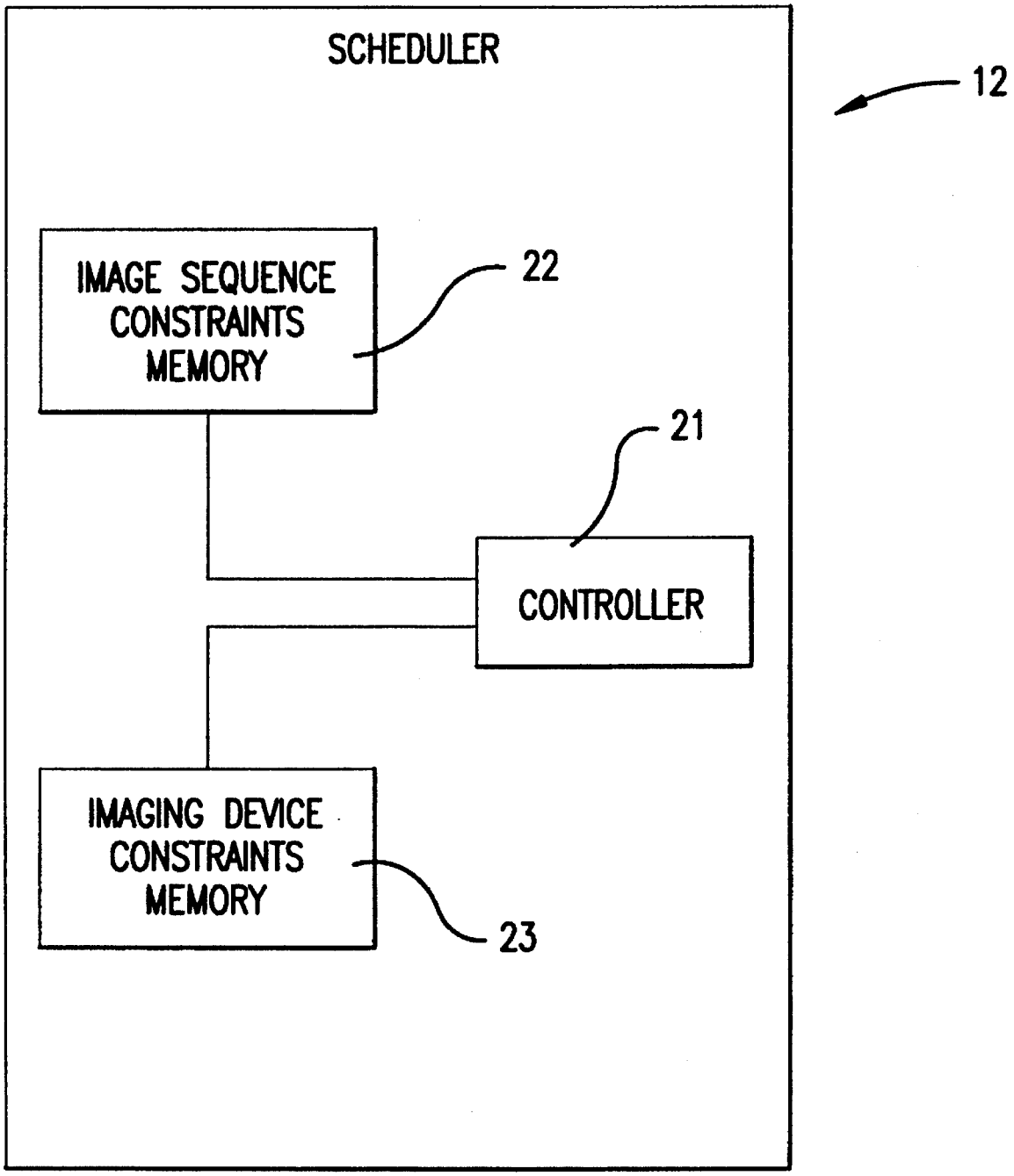
FIG. 2 is a detailed schematic view of the scheduler of FIG. 1.

In FIG. 2, a detailed view of the scheduler 12 is shown. The scheduler 12 includes a controller 21 that is connected to an image sequence constraints memory 22 and to an imaging device constraints memory 23. The image sequence constraints memory 22 stores image sequence constraints that must be satisfied in accordance with one or several jobs. The imaging device constraints memory stores imaging device constraints that must be satisfied in accordance with one or several imaging devices. Each of these types of constraints is discussed below in greater detail.

In general, the scheduler provides an optimized schedule for processing images in an imaging device according to user-selected criteria, the image sequence constraints and the imaging device constraints. Each constraint, if it is determined to apply to the current job, is weighted equally and must be obeyed in the optimized schedule. According to the present invention, each of the image sequence constraints, as well as some of the user selected criteria and imaging device constraints, are expressed mathematically. These mathematical expressions interrelate the desired criteria of the output job to the fundamental rules of paper handling (i.e., the image sequence constraints) and the operating limitations of the imaging device or imaging devices (i.e., the imaging device constraints). Moreover, the position occupied by a frame in a sheet in an imaging device is expressed mathematically such that the absolute and relative positions of all the frames in a job are known. The generality of the fundamental paper handling rules, as expressed by the image sequence constraints, permits determining a schedule that maximizes productivity irrespective of the particular type of imaging device used. Applying the specific operating limitations of the imaging device or imaging devices as expressed by the imaging device constraints, on the other hand, serves to adopt the schedule to the individual imaging device or group of imaging devices being used to output the particular job.

In the prior art, similar to the present invention, rules govern how data of a print job is recorded after inputting and constraints regarding the placing of one image before or after another image are noted and satisfied to achieve the desired sequence of images assigned to different frames. The prior art, however, is characterized by methods that arrange images on the frames sequentially rather than simultaneously. After a second image is tentatively scheduled behind a first image, the methods of the prior art select a third image to be scheduled behind, or ahead of, the second image in accordance with rules derived from a host of relevant constraints. The constraints are deemed to be relevant if they relate to the architecture of the imaging devices to which the scheduler output is applied. The constraints for a machine with one inverter are different from the constraints for a machine with two inverters. As a result, two different sets of constraints are required. Although the final arrangement may be changed later, the central thrust of the method, which is always preserved, is sequentially arranging images by placing images behind images or in front of images.

The present invention, although it reflects the same understanding that certain images have to be scheduled behind other images to satisfy particular constraints, is premised upon the consideration that all images are candidates for all frame positions and that each constraint, if applicable, is equally weighed. ! n other words, no particular constraint has precedence over the others. Therefore, the final frame scheduling is an arrangement in which all images are determined simultaneously while the total number of required frames is maintained as low as possible. Because this is a global objective, there are no local objectives of optimization. As a result, the constraints have to be expressed in linear equality or inequality equations in terms of frames. The system of equations is then solved by a known optimization method to ensure that the required number of frames is a result of minimizing the entire equation set.

The present invention is particularly well-suited for use in imaging devices having invertors and duplex loops for duplex paper printing. These devices can include a hold station that holds a sheet of paper at the exit end of the invertor before it enters the inlet point of the loop or at the exit point of the duplex loop before the sheet is to enter the paper path to receive the image on the second side of the sheet. In the prior art, however, there is no way to determine how long, in terms of skipped pitches, a duplex sheet must be held at that holding station before it is allowed to move again. The prior art criterion is arbitrarily set by experience. However, because the present application can determine a mathematical optimum for each duplex sheet in the entire job, the present invention can also determine how many skipped pitches are reserved for each duplex sheet at the invertor and at the duplex loop so that the total number of frames used in this particular printing job can be minimized. In one example, a sheet was held at the loop for 18 skipped pitches before reentry. Only a mathematical optimization similar to the present invention could predict such an extended delay.

Figure 3:
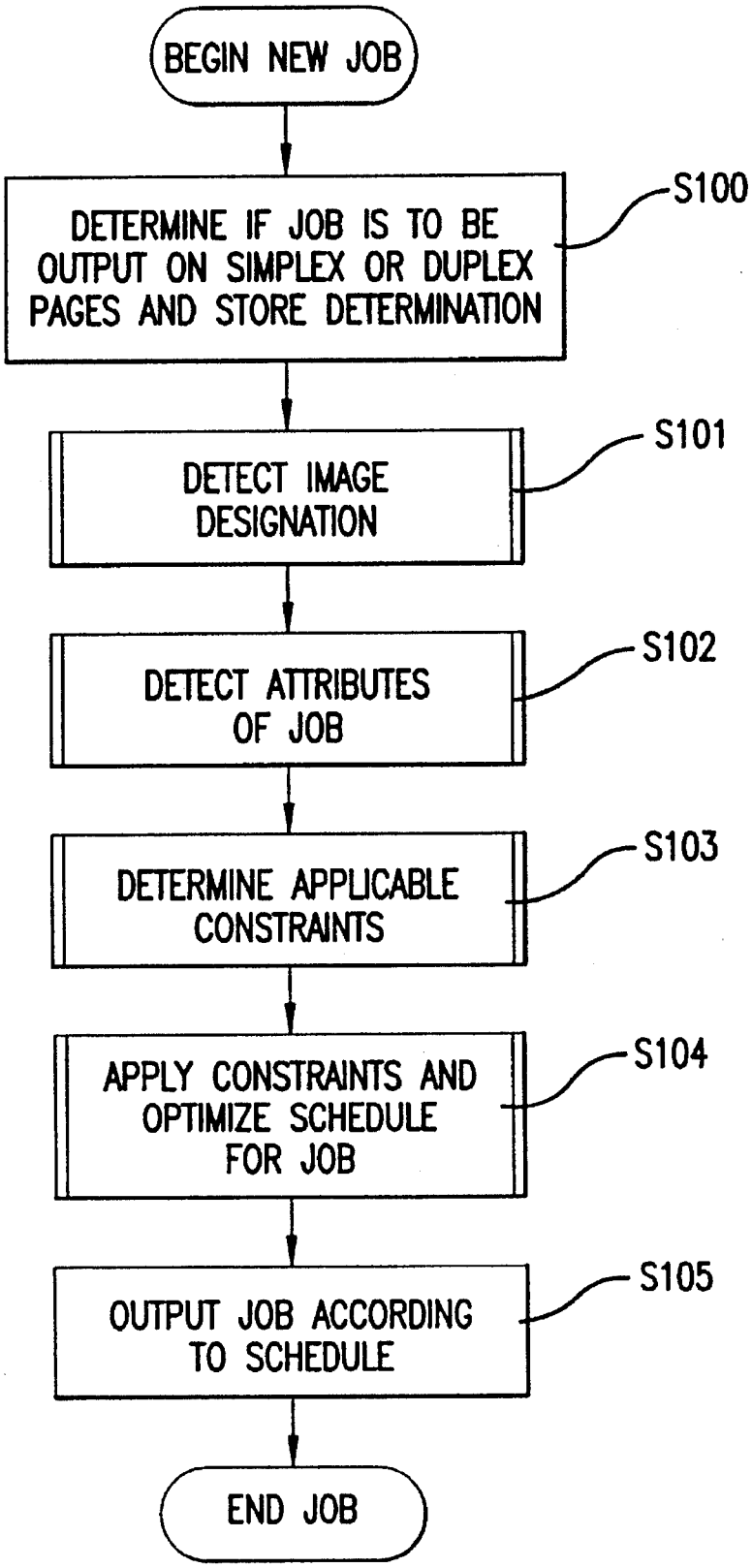
FIG. 3 is a summary flow chart showing the steps performed by the controller according to the method of the present invention.

An overview of the steps performed by the controller 21 of the scheduler 12 of one embodiment of the present invention is shown in FIG. 3. In operation, after a new job is initiated, the controller determines whether a sheet in a job is to be output in simplex (i.e., one-sided) or duplex (i.e., two-sided) form (step S100). This determination can be made automatically or according to an input received from the input device 16. Although the procedure followed in scheduling simplex output apparently differs from that followed in scheduling duplex output, the duplex output scheduling procedure can be followed with either type of output.

In step S101, the controller detects a designation of each image in the job. In step S102, the controller detects various attributes of the job. In step S103, the controller 21 determines the applicable constraints to be applied to the job by: (i) comparing the detected image designations with the image sequence constraints stored in the image sequence constraints memory 22, and (ii) comparing the detected attributes of the job with the imaging device constraints stored in the imaging device constraints memory 23. In step S104, the controller applies the applicable constraints and optimizes the scheduler for outputting the job such that none of the constraints is violated. In step S105, the controller outputs the job according to the schedule. These steps are explained below in greater detail.

Figure 4A:
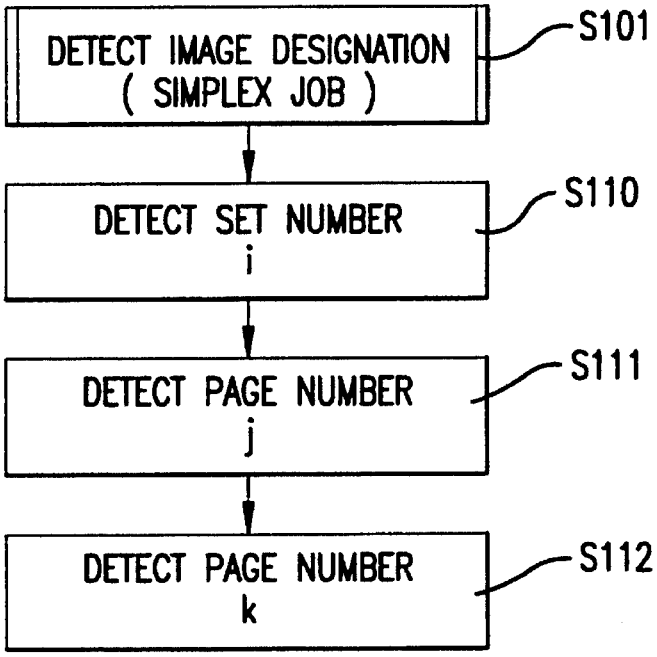
FIGS. 4*a* and 4*b* are flow charts showing the steps performed by the controller in detecting a designation of each image.

In FIG. 4*a*, the steps performed by the controller to detect the image designations (step S101) for a simplex page are shown. In step S110, the controller detects a set number i. The set number i is the desired number of duplicates of each image. In step S111, the controller detects a page number j. In step S112, the controller detects a pass number k. The pass number k designates the number of a pass for a particular page. For example, conventional color printing requires four passes (i.e., k=1, 2, 3, 4), corresponding to the four primary colors, to complete a single page.

Figure 4B:
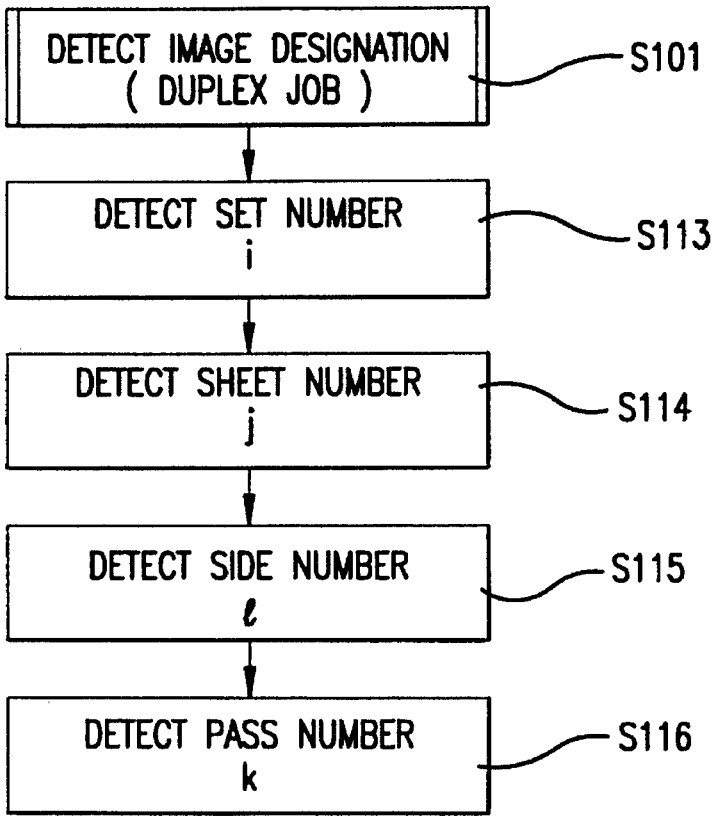

In FIG. 4*b*, the steps performed by the controller to detect image designations for a duplex page are shown. Duplex image designations can be used to identify images to be output in a duplex format, a simplex format or a mixed duplex and simplex format. In step S113, the controller detects a set number i. In step S114, the controller detects a sheet number j. In step S115, the controller detects a side number l. In contrast to the simplex image designations described above, each side Z of each sheet j is also designated. In step S116, the controller detects a pass number k.

Figure 5:
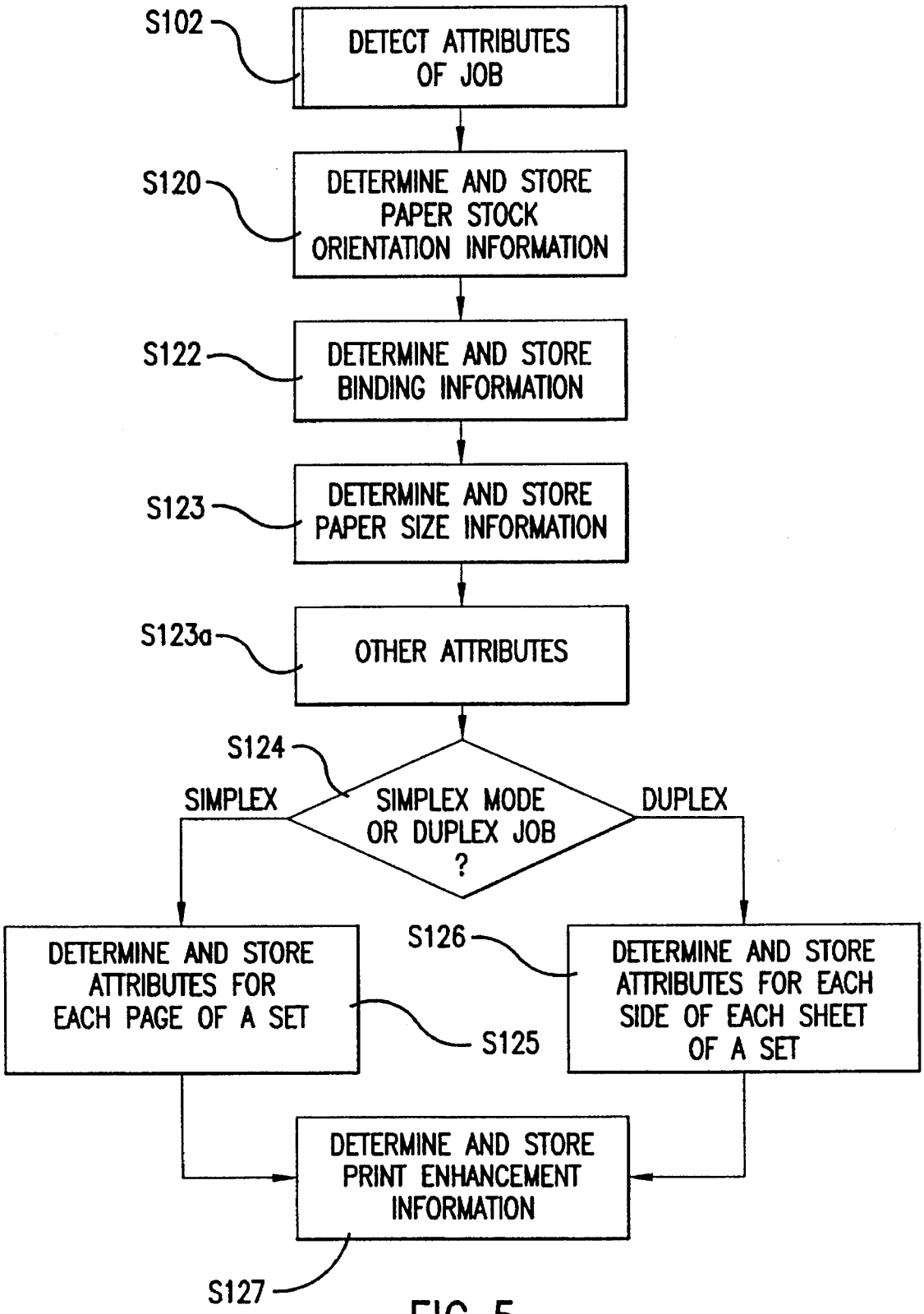
FIG. 5 is a flow chart showing the steps performed by the controller in detecting attributes of a job.

In FIG. 5, the steps performed by the controller in detecting the job attributes (step S102) are shown. In step S120, the controller determines if this paper stock on which the image is desired to be output is orientation sensitive or plain. Orientation sensitive paper stock includes, e.g., paper stock having pre-punched holes along one of its edges. In step S121, the controller determines whether each set of the job is to be bound. If each set is to bound, the controller determines if the sets are to be stapled (step S122). In step S123, the controller determines if each image is to be output on paper of the same size or on paper of mixed sizes. In step S123*a*, other attributes of the job in addition to those specifically described above, but within the concept of the present invention, are determined. In step S124, the controller recalls whether the pages are to be copied in a simplex mode or a duplex mode. In the case of a simplex job, the controller determines output attributes for each page j of the sets k (step S125). In the case of a duplex job, the controller determines output attributes for each side Z of each sheet j of the sets k (step S126). In step S127, the controller determines if the image should be output with print enhancements, such as, e.g., color printing and highlighting.

Figure 6:
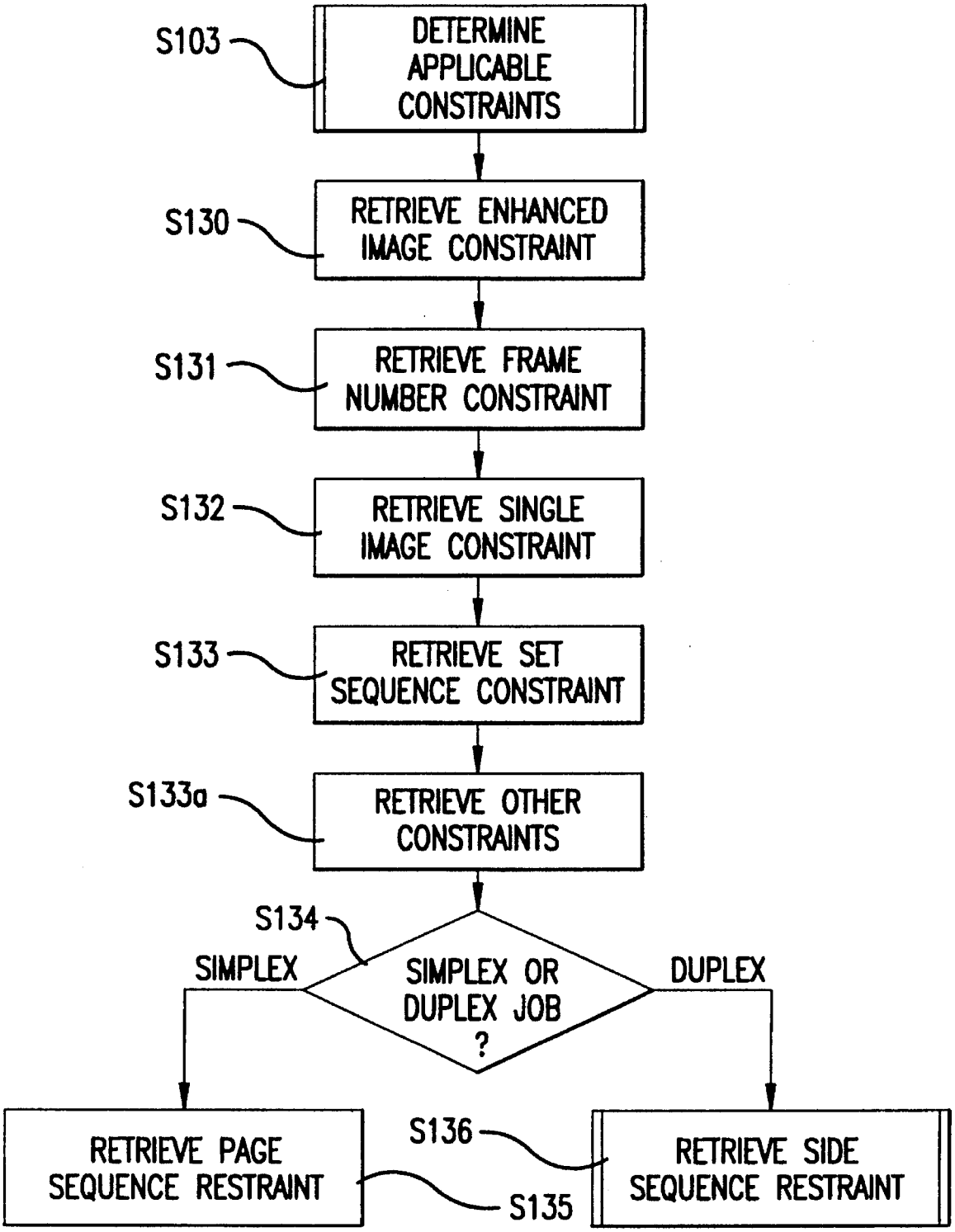
FIG. 6 is a flow chart showing additional steps performed by the controller in detecting attributes of a job.

In FIG. 6, the steps performed by the controller in determining the applicable constraints (step S103) are shown. In step S130, an enhanced image constraint is retrieved from the image sequence constraints memory 22. The enhanced image constraint requires that subsequent passes k necessary to produce an enhanced image are produced on the same pitch used to produce the first pass of the enhanced image. In step S131, a pitch number constraint is retrieved. The pitch number constraint requires that a pitch number is greater than or equal to 1. In step S132, a single image constraint is retrieved. The single image constraint requires that each image occupies a distinct pitch on the photoreceptor of the imaging apparatus. In step S133, a set sequence constraint is retrieved. The set sequence constraint requires that a last page of a first set is completed before a first page of a second set. In step S133*a*, other constraints in addition to those specifically described above, but within the concept of the present invention, are retrieved. In step S134, the controller recalls whether the job is a simplex job or duplex job. Because a frame occupies the space of a pitch along the photoreceptor, the terms pitch and frame as used herein are equivalent.

In the case of a simplex job, the controller further determines a page sequence constraint (step S135). The page sequence constraint requires that a second photoreceptor pitch number of a last pass of a second page exceeds a first pitch number of a last pass of a first page. In the case of a duplex job, a side sequence constraint is retrieved (step S136). The side sequence constraint requires that a second pitch number of a last pass of a second sheet must exceed a first pitch number of a last pass of a first sheet.

Figure 7:
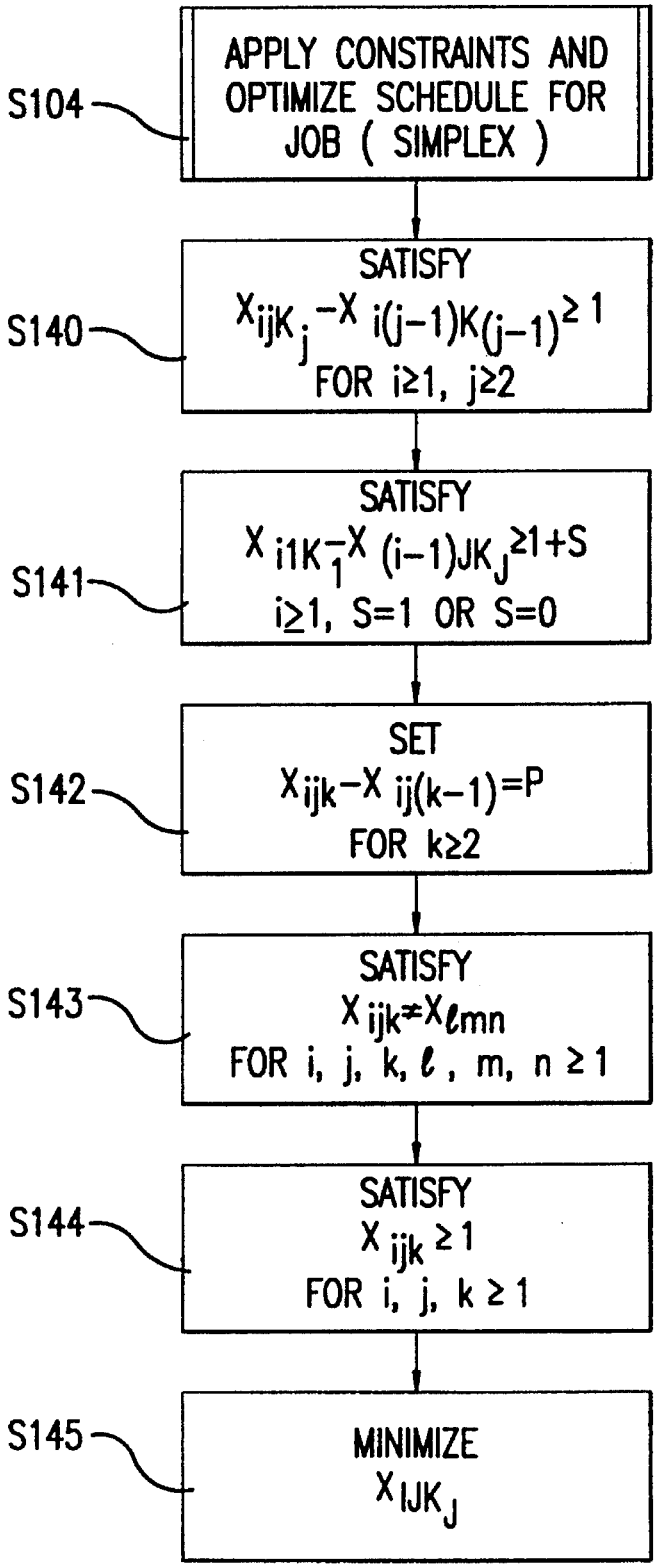
FIG. 7 is a flow chart showing the steps performed by the controller in applying the image sequence constraints and optimizing the schedule for a simplex job as mathematical expressions.
Figure 8:
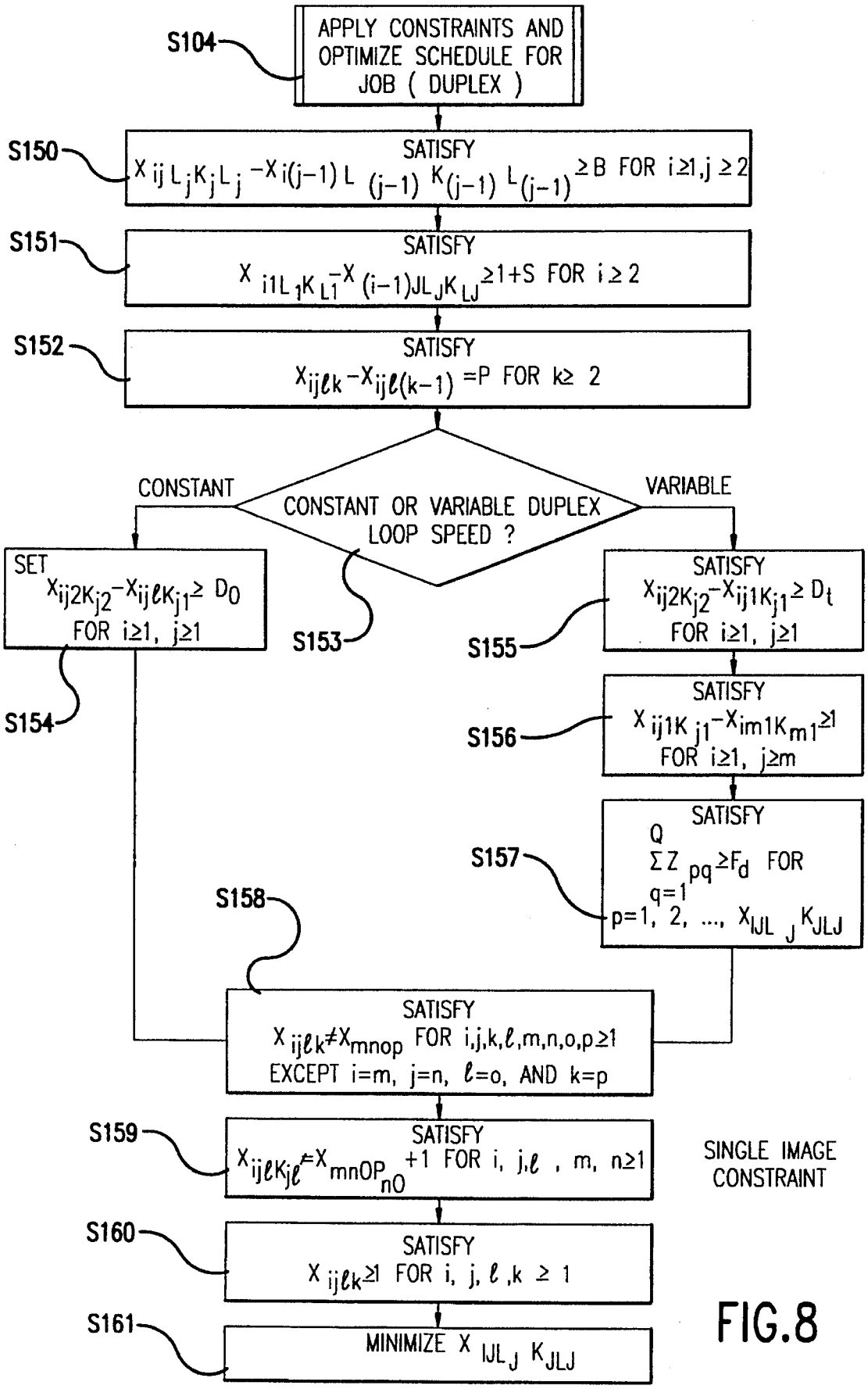
FIG. 8 is a flow chart showing the steps performed by the controller in applying the image sequence constraints and optimizing the schedule for a duplex job as mathematical expressions.

In FIGS. 7 and 8, the steps performed by the controller in determining the image sequence constraints for a simplex job and a duplex job, respectively, discussed above generally and in particular with respect to FIG. 6, are shown as expressed in mathematical form. Although the steps depicted in FIGS. 7 and 8 might appear to occur in a particular sequence, each of the constraints described in steps S140–S144 and S150–S160, respectively, is satisfied simultaneously, in the scheduler according to the present invention.

In determining the applicable constraints for a simplex job (step S104), the controller satisfies the page sequence constraint. The page sequence constraint is expressed as $$X_{ijK_j}-X_{i(j-1)K_{(i-1)}}\geqq 1 i\geqq 1, j\geqq 2 \quad (1)$$

where Xijk is the occupied frame number (beginning from frame number 1) on the photoreceptor for the image of set number i, page number j and pass number k (step S140). Further, I is the total number of sets in the job, J is the total number of pages, and Kj is the total number of passes for page j.

In step S141, the controller satisfies the set sequence constraint. The set sequence constraint is expressed as $$X_{i1K}-X_{(i-1)JK_J}\geqq 1+S;\ i\geqq 2 \quad (2)$$

where S denotes the number of pitches required to finish the previous set. The S pitches can still be used, but not to output the last pass of any particular page. The value of S depends upon the design of the particular imaging device. In one embodiment, S=1 for stapled sets and S=0 for stacked sets, i.e., an extra pitch is required to complete the processing of a stapled set before processing the next set.

In step S142, the controller satisfies the enhanced image constraint. The enhanced (or multipass) image constraint is expressed as $$X_{ijk}-X_{ij(k-1)}=P;\ k\geqq 2 \tag{3}$$

where P is the total number of pitches on the photoreceptor.

In step S143, the controller satisfies the single image constraint. The single image constraint is expressed as $$X_{ijk}\neq X_{lmn} i,j,k,l,m,n\geqq 1 \text{ except } i=l j=m \text{ and } k=n \tag{4}$$

The solution of the single image constraint is discussed below in greater detail.

In step S144, the controller satisfies the pitch number constraint. The pitch number constraint is expressed as $$X_{ijk}\geqq 1;\ i,j,k\geqq 1 \tag{5}$$

Assuming that all of the valid constraints for the particular imaging device and job have been processed, the controller optimizes the schedule for processing this simplex job in accordance with each given constraint such that the total number of required pitches is minimized in step S146. The minimization is expressed as $$\text{Obj: } \min(X_{ijK_j}) \tag{6}$$

In the case of a duplex job as shown in FIG. 8, the controller determines the applicable constraints where $X_{ijkl}$ is the occupied pitch number (beginning from pitch number 1) on the photoreceptor for the image of set number i, sheet number j, side number 1 and pass number k (step S140). Further, I is the total number of sets, J is the total number of pages, $L_j$ is the total number of sides for sheet j and $K_{jl}$ is the total number of passes for side l of sheet j.

In step S150, the controller satisfies the side sequence constraint. The side sequence constraint is expressed as $$X_{ijL_jK_{jL_j}}-X_{i(j-1)K_{j-1)L(J-1)}}\geqq B;\ i\geqq 1, j\geqq 2 \tag{7}$$

where B is equal to 2 when the previous sheet is duplex and the next sheet is simplex because additional time is required to invert the duplex sheet before it can be outputted and before the simplex can follow it. For two or more consecutive simplex or duplex sheets, B is equal to 1.

In step S151, the controller satisfies the set sequence constraint for a duplex job. The set sequence constraint for a duplex job is expressed as $$X_{i1L_1K_{L1}}-X_{(i-1)JL_jK_{LJ}}\geqq 1+S;\ i\geqq 2 \tag{8}$$

where S denotes the number of pitches required to finish the previous set. As described above, the value of S depends upon the design of the device.

In step S152, the controller satisfies the enhanced image constraint for a duplex job. The enhanced image constraint for a duplex job is expressed as $$x_{ijlk}-X_{ijl(k-1)}=P;\ k\geqq 2 \tag{9}$$

where P is the total number of pitches on the photoreceptor. In step S153, the controller recalls whether the imaging device to which the job will be output has a constant duplex loop speed or a variable duplex loop speed in determining the side sequence constraint to be applied. In the case of a constant duplex loop speed, the side sequence constraint is expressed as $$X_{ij2K_{j2}}-X_{ij/K_{j1}}=D_0;\ i,j\geqq 1 \tag{10}$$

In the case of a variable duplex loop speed, the side sequence constraint includes three additional constraints. First, the controller must satisfy a duplex loop paper speed constraint for a variable duplex loop speed. The duplex loop paper speed constraint for a variable speed duplex loop is expressed as $$X_{ij2K_{j2}}-X_{ij1K_{j1}}\geqq D_t;\ i,j\geqq 1 \tag{10A}$$

where $D_t$ is the number of pitches that move along the photoreceptor as the paper circulates through the duplex loop at the maximum speed. Second, a duplex loop entry order constraint must be satisfied. The duplex loop entry order constraint is expressed as $$X_{ij1K_{j1}}-X_{im1K_{m1}}\geqq 1;\ i\geqq 1, j>m \tag{10B}$$

Third, a duplex loop paper limit constraint must be satisfied. The duplex loop paper limit constraint is expressed as $$\sum_{q=1}^{Q} Zpq \leqq F_d;\quad p=1,2\ldots X_{IJL_jK_{JL}} \tag{10C}$$

where all duplex sheets in sequence, Q=1, 2, 3, . . . ,Q and where Q is the total number of duplex sheets in the specified job. $Z_{pq}$ is equal to 0 if the sheet Q is not in the duplex loop when the photoreceptor is turning to pitch number p. On the other hand, $Z_{pq}$ is equal to 1 if sheet Q is inside the duplex loop when the photoreceptor is turning to the pitch number p and $F_d$ is the maximum number of sheets that the duplex loop can contain.

In step S158, the controller satisfies the single image constraint for a duplex job. The single image constraint for a duplex job is expressed as $$X_{ijlk}\neq X_{mnop};\ i,j,l,k,m,n,p\geqq 1, \text{ except } i=m, j=n, l=o \text{ and } k=p \tag{11}$$

In step S159, the controller satisfies a simplex output pass constraint. The simplex output pass constraint requires that the pitch immediately before a simplex output pass not be occupied by a final pass of a duplex sheet. The simplex output pass constraint is expressed as $$X_{ijlK_{jl}}\neq X_{mnOP_{nO}}+1;\ i,j,l,m,n\geqq 1 \tag{12}$$

In step S160, the controller satisfies the frame number constraint for a duplex job. The frame number constraint for a duplex job is expressed as $$X_{ijlk}\geqq 1;\ i,j,l,k\geqq 1 \tag{13}$$

In step S161, the controller optimizes the schedule for processing the duplex job in accordance with each constraint such that the number of required pitches is minimized. The minimization is expressed as $$\text{Obj: } \min(X_{IJL_jK_{jLI}}) \tag{14}$$

Except for Equation 4 in the optimization of a simplex job and Equations 10C and 11 in the optimization of the duplex job, satisfying the other equations presents a standard linear optimization problem that can be solved with, e.g., the classical simplex method (i.e., the cutting plane method). Each of the three subscripts of Y of the simplex image designation and each of the four subscripts of Z of the duplex image designation are replaced by a single subscript representing the image number. For example, $Z_{1111}$ is replaced by $X_1$, which denotes the pitch number occupied by pass 1, side 1, sheet 1 of set 1. If N denotes the total number of passes for the entire job an $X_{SO}$ denotes any simplex output pass and $X_{DF}$ denotes any final pass of a duplex image, the simplex and duplex problems are rewritten as Obj:

$$\min\left(\sum_{j=1}^{N} a_{0j}X_j\right) \tag{15}$$

substituting, $$\sum_{j=1}^{N} a_{ij}X_j \leqq b_i;\quad i=1,2\ldots N_l \tag{16}$$

$$\sum_{j=1}^{N} a_{ij}X_j \geqq b_i;\quad i=N_l+1, N_l+2\ldots N_l+N_g \tag{17}$$

$$\sum_{j=1}^{N} a_{ij}X_j = b_i;\quad i=N_l+N_g+1, N_l+N_g+2\ldots N_l+N_g+N_e \tag{18}$$

$$X_j \geqq 0;\ j=1,2\ldots N \tag{19}$$

$$X_j \neq X_i;\ i,j=1,2\ldots N \text{ and } i\neq j \tag{20}$$

$$X_{dj} \neq X_{so}+1; \tag{21}$$

where $N_l$, $N_g$ and $N_e$ are the equation numbers for the types of equations shown as Equations 16, 17 and 18, respectively. The equations above represent the basic computational model for the optimized scheduler, referred to as "Model A." Slack variables $Y_i$, which are unknown integer constraints, are introduced to transform Equations 16 and 17 from inequalities into equalities. Equations 16 and 17 become $$\sum_{j=1}^{N} a_{ij}X_j + Y_i = b_i;\quad i=1,2\ldots N_l \tag{16A}$$

$$\sum_{j=1}^{N} a_{ij}X_j - Y_i = b_i;\quad i=N_l+1, N_l+2\ldots N_l+N_g \tag{17A}$$

The optimization problem expressed in Equation 15, subject to the constraints expressed in Equations 16A, 17A, 18 and 19 (i.e., "Model B"), is solved and the unknown variables are determined.

To satisfy Equations 4, 10C and 11, the slack variables are either increased or decreased from their known values to eliminate "multiple occupancies." Multiple occupancies reflect interim solutions in which more than a single image is assigned to each frame—a condition that violates the single image constraint. Because an integer solution to the problem necessarily exists, however, an overall solution is guaranteed. By progressively varying the slack variables, the overall solution is eventually achieved.

Figure 10:
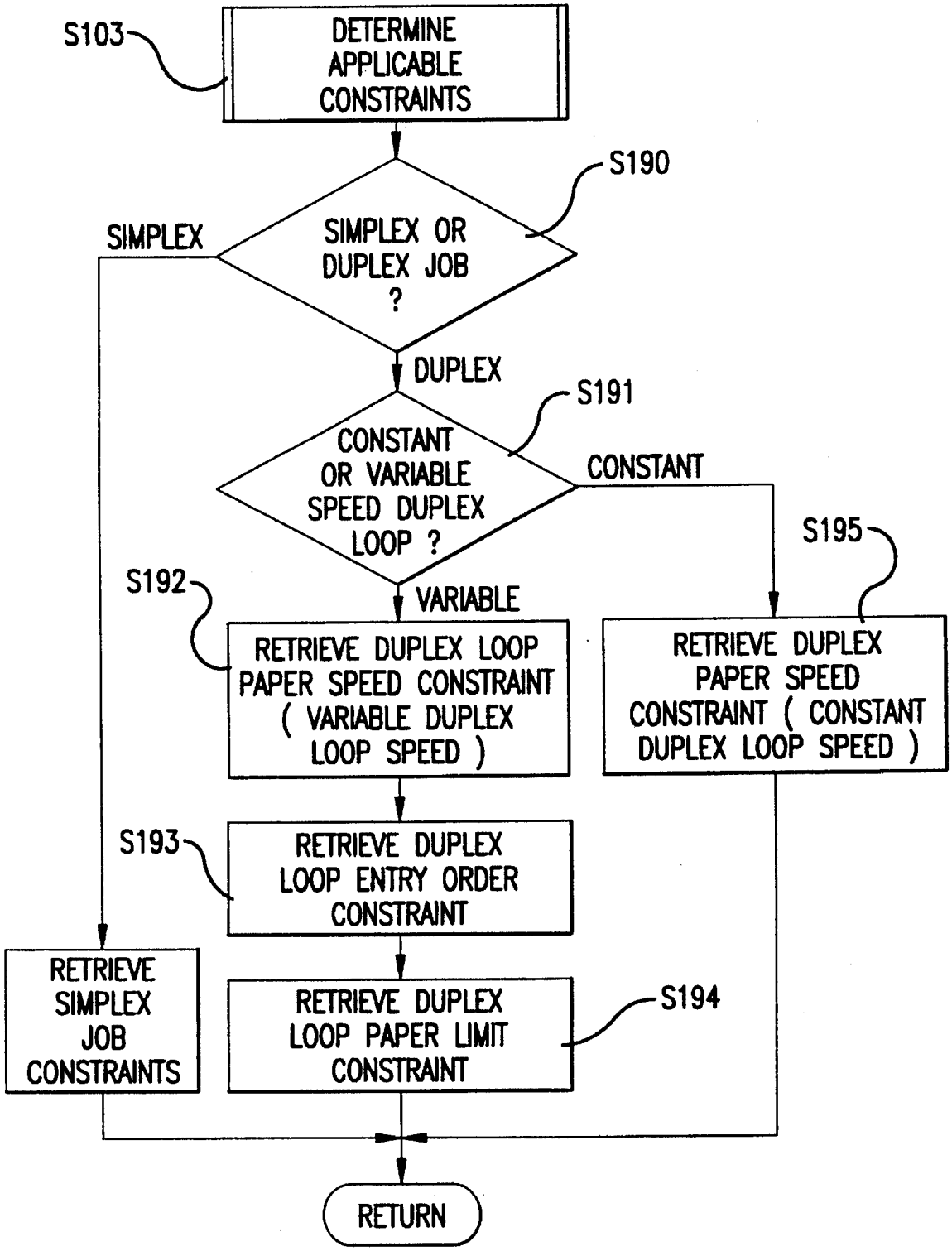
FIG. 10 is a flow chart showing the steps performed by the controller in determining the applicable imaging device constraints.

In FIG. 10, additional steps performed by the controller in determining the applicable constraints (step S103) are shown. In each of the steps, the applicable constraint is either purely device-dependent or dependent upon the particular device and also related to the image sequence. In step S190, the controller recalls whether the job is a simplex job or a duplex job. Listed below are examples of various constraints that may be applicable in the case of processing a duplex job in known finishing devices. Of course, other devices may require satisfying different constraints, so these examples are illustrative rather than limiting.

If the job is a duplex job, the controller determines whether the imaging device has a constant speed duplex loop or a variable speed duplex loop (step S191). If the imaging device has a variable speed duplex loop, the controller retrieves the variable speed duplex loop paper speed constraint (step 192), the duplex loop entry order constraint (step 193) and the duplex loop paper limit constraint (step 194). The variable speed duplex loop paper speed constraint requires that a paper in the duplex loop travels at a speed less than or equal to a maximum variable speed $D_l$ of the photoreceptor. The duplex loop entry order constraint ensures that no jam occurs within the duplex loop by requiring that the order in which a paper exits the duplex loop is the order in which the paper entered the loop. The duplex loop paper limit constraint requires that the number of duplex sheets in the duplex loop at any particular time is less than or equal to a maximum number of duplex sheets $F_d$.

If, on the other hand, the speed of the duplex loop is constant, the controller retrieves the constant speed duplex loop speed constraint (step S195). Similar to the variable speed duplex loop speed constraint described above, the constant speed duplex loop speed constraint requires that a paper within the duplex loop travels at a speed less than or equal to a maximum constant speed Do of the duplex loop.

Similarly, if the job is determined to be a simplex job in step S190, the controller retrieves the imaging device dependent constraints that apply in the case of a simplex job (step S196).

Figure 11:
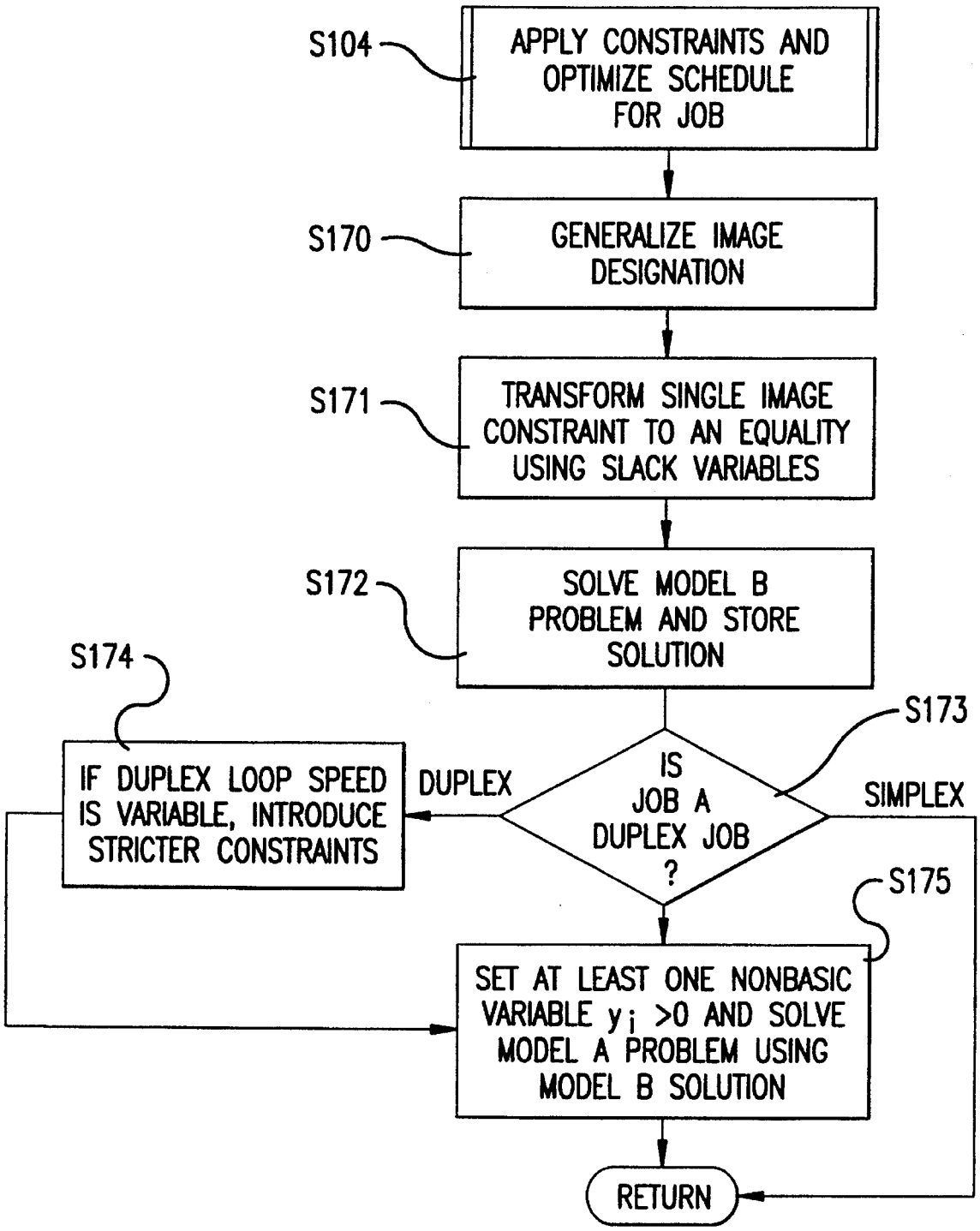
FIG. 11 is a flow chart showing the steps performed by the controller in applying the constraints and optimizing the schedule for the job that follow the steps shown in FIGS. 7 and 8.

In FIG. 11, the steps performed by the controller in applying the constraints and optimizing a schedule for completing the job (step S104) are shown. In step 170, the detected image designations for each image X (i.e., $X_{ijk}$ for a simplex job and $X_{ijlk}$ for a duplex job) are generalized. In step S171, as also discussed above, the single image constraint is transformed into an equality using slack variables. In step S172, the Model B problem is solved and the solution is stored. In one embodiment, the controller recalls whether a simplex or a duplex job is being processed (step S173). In the case of a duplex job, if the duplex loop speed is variable, stricter constraints are introduced (step S174). In step S175, at least one nonbasic variable $Y_i$ is set to a value greater than zero, and the Model A problem is solved using the Model B solution.

Figure 12:
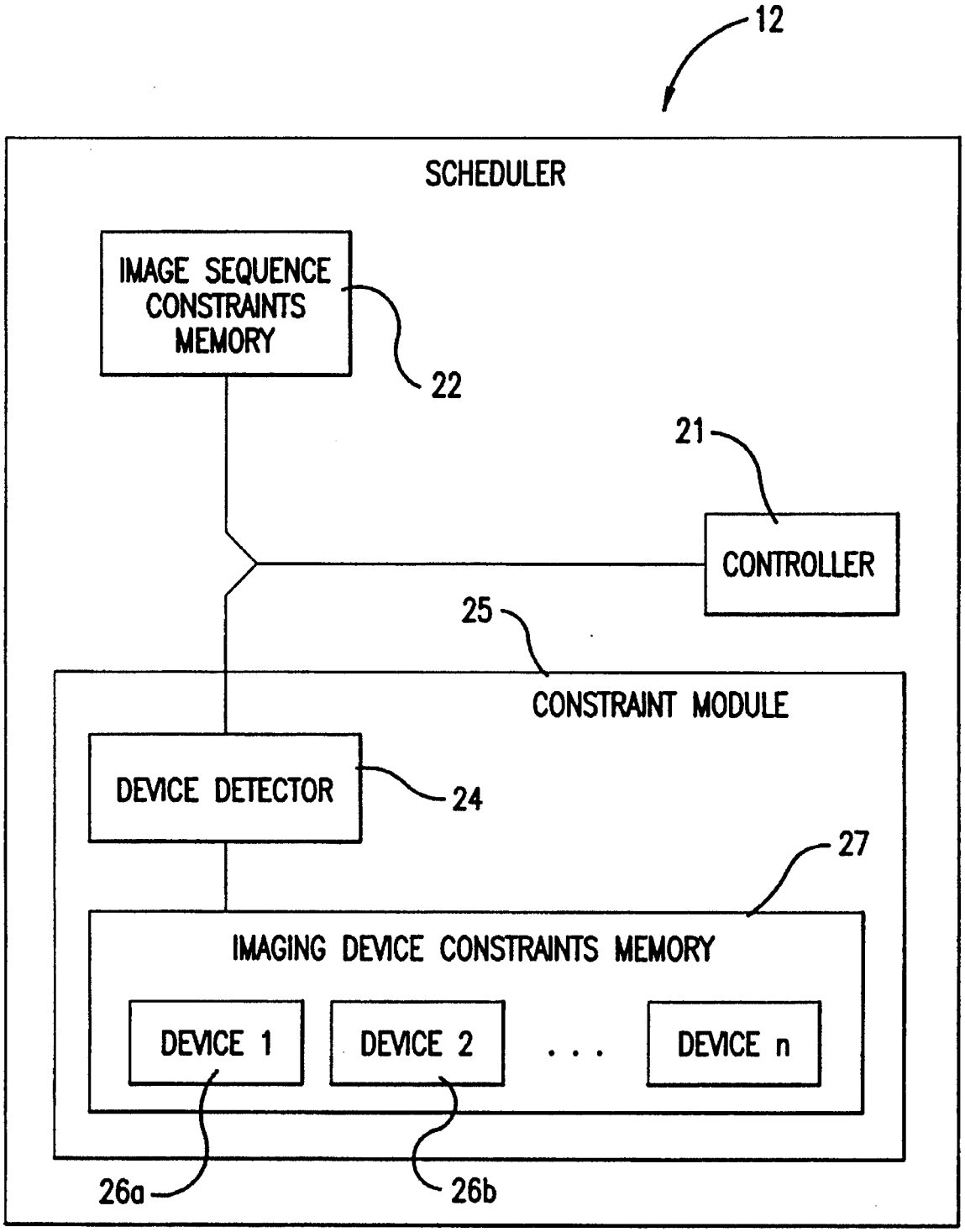
FIG. 12 is detailed schematic view of the scheduler according to a second embodiment of the invention.

In FIG. 12, another embodiment of the scheduler 12 of the present invention is shown. As shown in FIG. 12, the controller 21 is connected to a constraint module 25 and the image sequence constraints memory 22. The constraint module includes a device defector 24 that is connected to an imaging device constraints memory 27. In this embodiment, the imaging device constraints memory 27 stores the imaging device-dependent constraints for each of the imaging devices 1–n that are connected to the scheduler 12 in a memory block. For example, the constraints that relate to the first and the second imaging devices are stored in memory blocks **26*a* and 26*b***, respectively.

During the operation of the scheduler having the constraint module, substantially the same steps are performed as in the case of the scheduler described above (see, e.g., FIG. 3), except that more than one imaging device is available to process the desired images. In step S103, the device detector 24 signals the controller 21 to indicate which imaging devices are connected to the scheduler 12. The controller retrieves the image sequence constraints (steps S130—S136).

Figure 13:
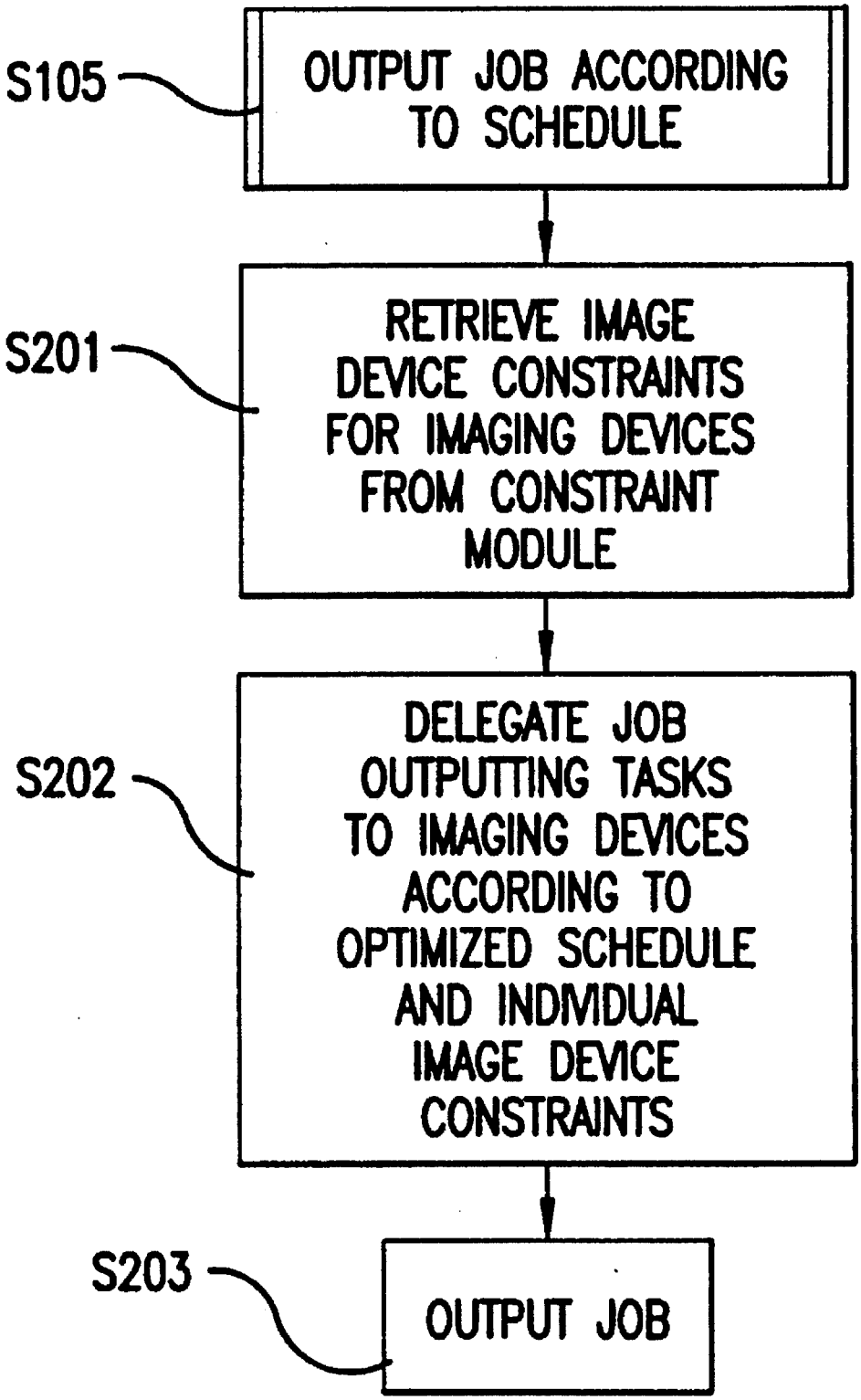
FIG. 13 is a flowchart showing the steps performed by the controller according to the second embodiment of the invention in outputting the job according to the optimized schedule.

In FIG. 13, the steps performed by the scheduler having a constraint module in outputting the job (step S105) are shown. In step S201, the controller recalls imaging device constraints for each imaging device in accordance with the imaging devices detected by the device detector 24. In step S202, the controller delegates various output tasks that comprise the job to one or more of the detected imaging devices in accordance with satisfying the optimized schedule (which includes the imaging device constraints). In step S203, the controller initiates the operation of the delegated imaging devices, and the job is output.

In other words, if a color printer and a standard copier with duplex capability are the devices connected to the scheduler 12, the device detector 24 will signal the controller 21 accordingly and the controller 21 will retrieve the imaging device constraints for each of the two detected devices. Once the optimized schedule is determined, the controller 21 will recall the imaging device constraints from the imaging device constraints memory in the constraint module and delegate the output tasks to the detected devices. In the case of a job that includes color sheets and black and white duplex sheets, the controller will delegate color printing to the color printer and black and white duplex printing to the standard copier with duplex capability. Because the black and white printing speed of a color printer is usually slow compared to the speed of a device designed solely to process black and white images, if the job is comprised entirely of black and white copying tasks, the controller may determine that the standard copier can process the entire job more quickly than if the job is delegated between both detected devices.

Although the preceding description assumes that the scheduler automatically detects, delegates tasks to and initiates the output of images from one or more imaging devices, any one or more of these steps can be manually overridden by a user. In other words, although the optimized schedule would use both a first detected imaging device and a second detected imaging device, the user can manually override the optimized schedule so that only the first detected imaging device is used.

Moreover, although the preceding description refers to imaging devices that are physically connected to the scheduler, the present invention can be embodied by any configuration in which the controller can retrieve the constraints applicable to a range of available imaging devices, and one or more of the available imaging devices can be delegated such that the job is output according to the optimized schedule. In another embodiment, for example, the constraints from each imaging device and the delegated tasks from the controller are exchanged via the use of magnetic tapes or other media.

Figure 9A:
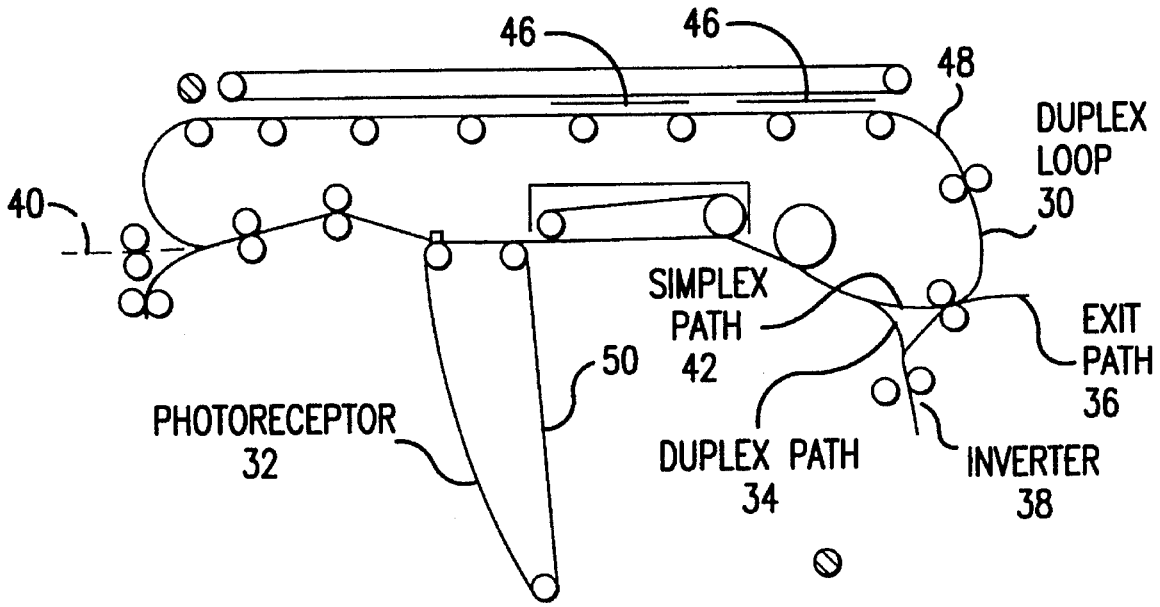
FIG.9a PRIOR ART
FIG. 9*a* is a schematic view of a conventional copy paper path in an imaging device.

In the discussion of FIGS. 9*a*–9*d* that follows, one specific implementation of the method and device of the present invention is described. Because those with ordinary skill in the art can suggest numerous other implementations, the example chosen for the purpose of description is intended to be illustrative, not limiting. In FIG. 9*a*, a copy paper path of a conventional photocopier having duplex copying capability is shown. Sheets of copy stock on which copies are to be made enter an endless duplex loop 30 at a copier stock entry point 40. The duplex loop 30 is configured such that several sheets 46, two of which are shown, occupy a predetermined number of positions (or pitches) and circulate on a belt driven by rollers. After a sheet enters the duplex loop 30, the belt transports it to a photoreceptor 32. The photoreceptor also includes several pitches on a circulating photoreceptor belt 50 for transferring desired images to the sheets within the photoreceptor 32.

Once an image is transferred to a sheet within the photoreceptor 32, the sheet continues along the duplex loop 30 until it reaches a point where the duplex loop 30 divides into a simplex path 42 and a duplex path 34. A simplex sheet follows the simplex path 42 and exits along an exit path 36. A duplex sheet, on the other hand follows the duplex path 34 and enters an inverter 38. The inverter 38 inverts the duplex sheet. If both the first and second sides of the duplex sheet have been copied, the duplex sheet exits the inverter 38 and follows the exit path 36. If only the first side of the duplex sheet has been copied, the duplex sheet reenters the duplex loop 30 and circulates through the photoreceptor 32 again so that the second side can be copied.

Because a simplex sheet does not travel through the inverter 38, the time required to process a simplex sheet is less than the time required to process a duplex sheet. If a job includes a simplex sheet that follows a duplex sheet, the job schedule must account for the shorter processing time of the simplex sheet. In other words, the distance between two consecutive sheets in the duplex loop 30 (i.e., the intercopy gap) must be increased to prevent the leading edge of the second simplex sheet from colliding with the trailing edge of the first duplex sheet. Conventionally, increasing the intercopy gap requires skipping a pitch along the photoreceptor belt 50. Accordingly, the schedule according to the conventional approach skips the second pitch after a first duplex sheet on a first pitch so that the second simplex sheet is positioned on a third pitch. Consequently, because the photoreceptor operates at less than its designed capacity under the conventional approach, the overall throughput and productivity of the copier decrease. If the processing time of the second simplex sheet, however, is synchronized such that the first duplex sheet is completed before the second simplex sheet, the skipped pitch and the resulting decrease in productivity can be eliminated.

Figure 9B:
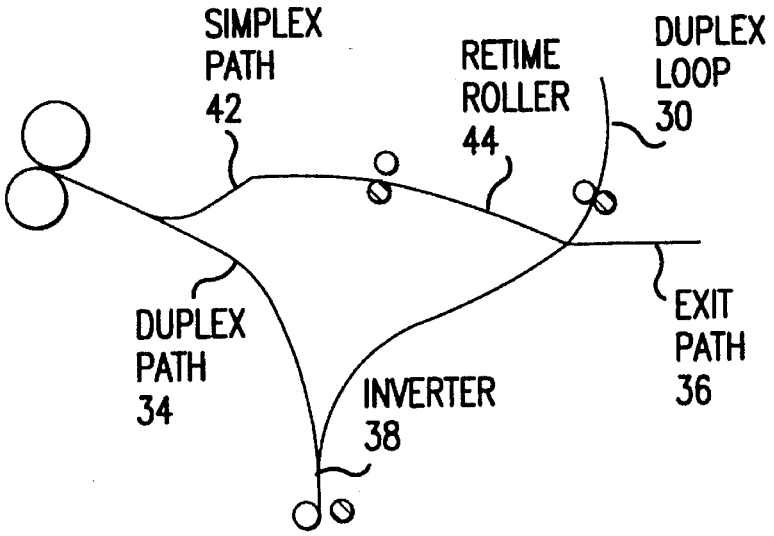
FIGS. 9*b*, 9*b*, and 9*d* are schematic views of a partial copy paper path in which a sheet in a simplex paper path is synchronized to follow a sheet in a duplex paper path according to the present invention.

According to the present invention, the processing times of a simplex sheet and a duplex sheet can be synchronized such that the second simplex sheet does not collide with the first duplex sheet. In one embodiment, as shown in FIG. 9*b*, a retime roller 44 is positioned in the simplex path 42 between the point at which the simplex path 42 and the duplex path 34 divide from the duplex loop 30 and the point at which the exit path 36 begins. The rotational speed of the retime roller 44 is adjusted such that the second simplex sheet is spaced from a first duplex sheet by a sufficient intercopy gap. Because the present invention does not require skipping an entire pitch on the photoreceptor belt 50, a high overall productivity is maintained.

Figure 9C:
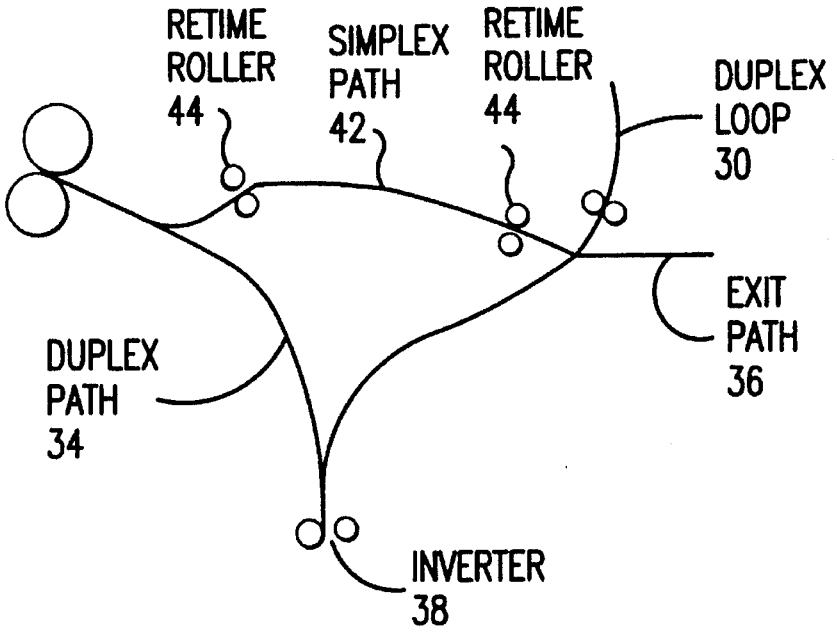
Figure 9D:
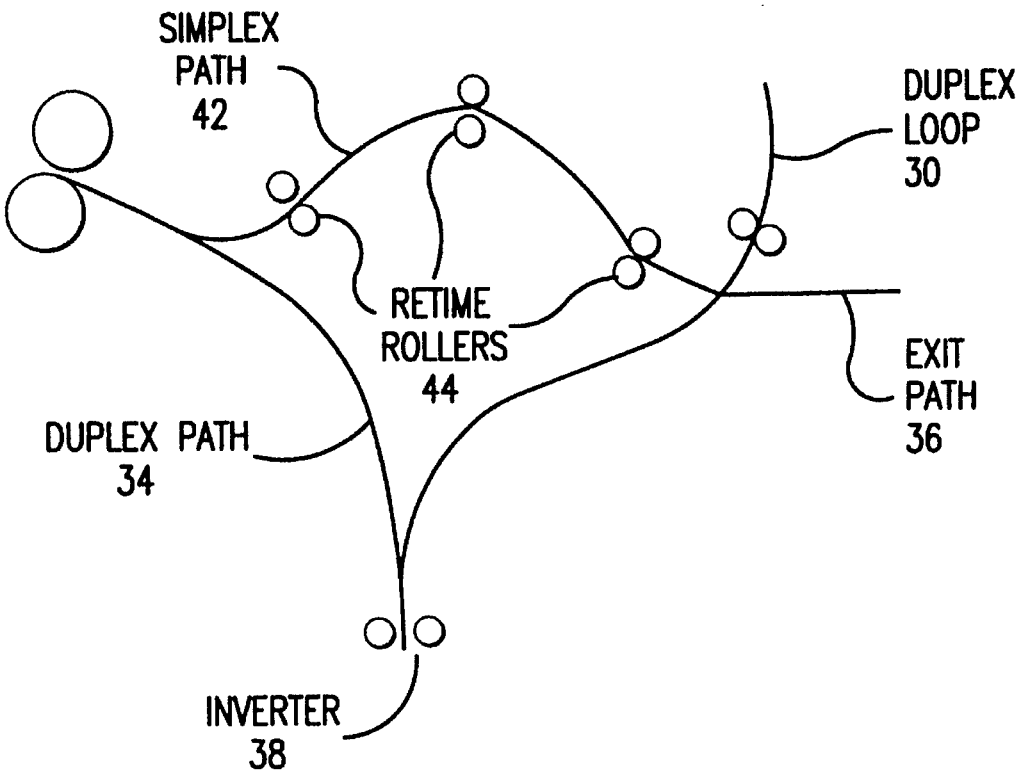

Additional embodiments of the synchronized simplex sheet path are shown in FIGS. 9*c* and 9*d*. In FIG. 9*b*, two pairs of retime rollers 44 are positioned between the point at which the simplex sheet path 42 and duplex sheet path 34 divide from the duplex loop 30 and the point at which the exit path 36 begins. In FIG. 9*d*, three such pairs of retiree rollers 44 are similarly positioned.

According to another embodiment, the speed at which the inverter 38 operates is varied to eliminate the need to skip pitches. In particular, the variable speed inverter 38 ensures that a sufficient intercopy gap can be scheduled between sheets of different lengths (i.e., different processing times) and sheets copied at different rates (e.g., a first color sheet requires a longer processing time than a second black and white sheet).

U.S. Pat. No. 5,337,135 to Malachowski discloses a variable speed duplex drive for varying the rate at which sheets travel within the duplex loop so that the number of skipped pitches is reduced. The speed of the simplex path is constant rather than variable in the device disclosed by Malachowski. In addition, the device disclosed by Malachowski does not address the problem of synchronizing a second simplex with a first duplex sheet so that no interference between the two sheets occurs.

In Examples 1–9 below, the operation of the scheduler according to the method of the present invention is illustrated.

EXAMPLE 1

In Example 1, the desired output includes black and white duplex pages mixed with black and white simplex pages. One set of 100 sheets is processed in a copier having five pitches in the duplex loop with no duplex loop delay. The copier has three pitches in the photoreceptor.

By way of comparison, a conventional scheduler requires 177 pitches (vs. 173) and 68.7 seconds of CPU time (vs. only 1.283 seconds). The productivity achieved by the conventional scheduler is also lower (0.80 vs. 0.82).

Number of Sets = 1
Number of Sheets = 100
Number of Pitches along Duplex Loop = 5, No Duplex Loop Delay
Number of Pitches on PR(photoreceptor) or TM = 3
Scheduling starts at set 1, sheet 1
Number of Required Pitches for Each Sheet:
Sheet # 1 2 3 4 5 6 7 8 9 10 11 12 13 14 15 16 17 18 19 20 21 22 23 24 25 26 27 28 29 30
Pitches 1 1 1 1 1 1 1 1 1 1 1 1 1 1 1 1 1 1 1 1 1 1 1 1 1 1 1 1 1 1
Sheet # 31 32 33 34 35 36 37 38 39 40 41 42 43 44 45 46 47 48 49 50 51 52 53 54 55 56 57 58 59 60
Pitches 1 1 1 1 1 1 1 1 1 1 1 1 1 1 1 1 1 1 1 1 1 1 1 1 1 1 1 1 1 1
Sheet # 61 62 63 64 65 66 67 68 69 70 71 72 73 74 75 76 77 78 79 80 81 82 83 84 85 86 87 88 89 90
Pitches 1 1 1 1 1 1 1 1 1 1 1 1 1 1 1 1 1 1 1 1 1 1 1 1 1 1 1 1 1 1
Sheet # 91 92 93 94 95 96 97 98 99 100
Pitches 1 1 1 1 1 1 1 1 1 1
Number of Passes for Side 1 of Each Sheet(Processing Side Number[COUNT]/Total Side Number):
1( 1/ 1) 1( 3/ 3) 1( 5/ 5) 1( 7/ 7) 1( 8/ 9) 1( 9/11) 1(10/13) 1(11/15) 1(12/17) 1(14/19)
1(15/21) 1(16/23) 1(17/25) 1(19/27) 1(20/29) 1(22/31) 1(23/33) 1(25/35) 1(26/37) 1(28/39)
1(30/41) 1(32/43) 1(33/45) 1(34/47) 1(35/49) 1(36/51) 1(37/53) 1(39/55) 1(41/57) 1(43/59)
1(45/61) 1(46/63) 1(48/65) 1(49/67) 1(51/69) 1(53/71) 1(55/73) 1(56/75) 1(57/77) 1(59/79)
1(61/81) 1(62/83) 1(63/85) 1(64/87) 1(66/89) 1(68/91) 1(70/93) 1(72/95) 1(74/97) 1(75/99)
1(76/101) 1(77/103) 1(79/105) 1(81/107) 1(83/109) 1(85/111) 1(86/113) 1(87/115) 1(88/117) 1(90/119)
1(91/121) 1(92/123) 1(94/125) 1(95/127) 1(96/129) 1(97/131) 1(98/133) 1(100/135) 1(101/137) 1(102/139)
1(103/141) 1(104/143) 1(105/145) 1(106/147) 1(107/149) 1(109/151) 1(110/153) 1(111/155) 1(113/157) 1(114/159)
1(116/161) 1(117/163) 1(118/165) 1(119/167) 1(120/169) 1(121/171) 1(122/173) 1(123/175) 1(125/177) 1(127/179)
1(129/181) 1(131/183) 1(133/185) 1(134/187) 1(135/189) 1(136/191) 1(137/193) 1(139/195) 1(140/197) 1(141/199)
Number of Passes for Side 2 of Each Sheet(Processing Side Number[COUNT]/Total Side Number):
1( 2/ 2) 1( 4/ 4) 1( 6/ 6) 0( / 8) 0( /10) 0( /12) 0( /14) 0( /16) 1(13/18) 0( /20)
0( /22) 0( /24) 1(18/26) 0( /28) 1(21/30) 0( /32) 1(24/34) 0( /36) 1(27/38) 1(29/40)
1(31/42) 0( /44) 0( /46) 0( /48) 0( /50) 0( /52) 1(38/54) 1(40/56) 1(42/58) 1(44/60)
0( /62) 1(47/64) 0( /66) 1(50/68) 1(52/70) 1(54/72) 0( /74) 0( /76) 1(58/78) 1(60/80)
0( /82) 0( /84) 0( /86) 1(65/88) 1(67/90) 1(69/92) 1(71/94) 1(73/96) 0( /98) 0( /100)
0( /102) 1(78/104) 1(80/106) 1(82/108) 1(84/110) 0( /112) 0( /114) 0( /116) 1(89/118) 0( /120)
0( /122) 1(93/124) 0( /126) 0( /128) 0( /130) 0( /132) 1(99/134) 0( /136) 0( /138) 0( /140)
0( /142) 0( /144) 0( /146) 0( /148) 1(108/150) 0( /152) 0( /154) 1(112/156) 0( /158) 1(115/160)
0( /162) 0( /164) 0( /166) 0( /168) 0( /170) 0( /172) 0( /174) 1(124/176) 1(126/178) 1(128/180)
1(130/182) 1(132/184) 0( /186) 0( /188) 0( /190) 0( /192) 1(138/194) 0( /196) 0( /198) 0( /200)
Legend:
COUNT #: 1 2 3 4 5 6 7 8 9 10 11 12 13 14 15 16 17 18 19 20 21 22 23 24 25 26 27 28 29 30
Symbol: 1 2 3 4 5 6 7 8 9 A B C D E F G H I J K L M N O P Q R S T a
COUNT #: 31 32 33 34 35 36 37 38 39 40 41 42 43 44 45 46 47 48 49 50 51 52 53 54 55 56 57 58 59 60
Symbol: 1 2 3 4 5 6 7 8 9 A B C D E F G H I J K L M N O P Q R S T b
COUNT #: 61 62 63 64 65 66 67 68 69 70 71 72 73 74 75 76 77 78 79 80 81 82 83 84 85 86 87 88 89 90
Symbol: 1 2 3 4 5 6 7 8 9 A B C D E F G H I J K L M N O P Q R S T c
COUNT #: 91 92 93 94 95 96 97 98 99100101102103104105106107108109110111112113114115116117118119120
Symbol: 1 2 3 4 5 6 7 8 9 A B C D E F G H I J K L M N O P Q R S T d
COUNT #: 121122123124125126127128129130131132133134135136137138139140141
Symbol: 1 2 3 4 5 6 7 8 9 A B C D E F G H I J K L
Pitch Location for each COUNT:
1
1 2 3 4 5 6 7 8 9 0
Frame#1234567890123456789012345678901234567890123456789012345678901234567890123456789012345678901234567890
Set 1:13524678C*9ABDH*EFGIK*JN*L*MOQSa*PRT1*2345679*BD8AGCE*FHJLN*IKMORT*PQSb*123468AC579BD*EFGHJLN*IKM
1 1 1 1 1 1 1 1 1 2
1 2 3 4 5 6 7 8 9 0
Frame#1234567890123456789012345678901234567890123456789012345678901234567890123456789012345678901234567890
Set 1:O*PS*QR2T*c13*48*5679*ABCDH*EFGI*JL*KO*M*NP*QRSTd123579B468AC*DH*EFGI*JKL————
Number of Images per Set: 141
Total Number of Images: 141
Total Number of Frames Used: 173
Productivity: 141/173 = 0.82
CPU Time Used for This Analysis: 1.283 Seconds

EXAMPLE 2

In Example 2, the desired output is black and white simplex pages mixed with color simplex pages in a stacked condition. Three sets of three sheets are processed by a copier having three pitches in the photoreceptor.

Number of Sets = 3
Number of Sheets = 3
Number of Pitches on PR or TM = 3
Stack, No Stapling Delay.
Scheduling starts at set 1, sheet 1
Developer: Image on Image
Number of Required Pitches for Each Sheet:
Sheet # 1 2 3

-continued

```
Pitches 1 1 1
Number of Passes for Side 1 of Each Sheet(Processing Side Number[COUNT]/Total Side Number):
4( 1/ 1) 1( 2/ 3) 1( 3/ 5)
Number of Passes for Side 2 of Each Sheet(Processing Side Number[COUNT]/Total Side Number):
0( / 2) 0( / 4) 0( / 6)
Pitch Location for each COUNT:
                1
    1 2 3 4 5 6 7 8 9 0
Frame #1234567890123456789012345678901234567890123456789012345678901234567890123456789012345678901234567890
Set 1:1**1**1**1**2**3————————————————————————————————————————
Set 2:——1**1**1**1*23————————————————————————————————————
Set 3:———1**1**1**123————————————————————————————————————
Number of Images per Set: 6
Total Number of Images: 18
Total Number of Frames Used: 23
Productivity: 18/23 = 0.78
CPU Time Used for This Analysis: 0.017 Seconds
```

EXAMPLE 3

In Example 3, the desired output is black and white simplex sheets mixed with color simplex sheets after a jammed restart condition has occurred. Four sets of three sheets are processed in a copier having a photoreceptor with three pitches. In Example 3, the scheduling starts at set 1, sheet 2, because sheet 1 of set 1 has exited and the jam restart begins at sheet 2 of set 1.

```
Number of Sets = 4
Number of Sheets = 3
Number of Pitches on PR or TM = 3
Stack, No Stapling Delay.
Scheduling starts at set 1, sheet 2(assume sheet 1 of set 1 has exitted and jammed restart begins at sheet 2 of set 1)
Developer: Image on Image
Number of Required Pitches for Each Sheet:
Sheet # 1 2 3
Pitches 1 1 1
Number of Passes for Side 1 of Each Sheet(Processing Side Number[COUNT]/Total Side Number):
4( 1/ 1) 1( 2/ 3) 1( 3/ 5)
Number of Passes for Side 2 of Each Sheet(Processing Side Number[COUNT]/Total Side Number):
0( / 2) 0( / 4) 0( / 6)
Pitch Location for each COUNT:
                1
    1 2 3 4 5 6 7 8 9 0
Frame #1234567890123456789012345678901234567890123456789012345678901234567890123456789012345678901234567890
Set 1:—23————————————————————————————————————————————
Set 2:1**1**1**1**2**3————————————————————————————————————
Set 3:——1**1**1**1*23————————————————————————————————————
Set 4:———1**1**1**123————————————————————————————————————
Number of Images per Set: 6
Total Number of Images: 20
Total Number of Frames Used: 23
Productivity: 20/23 = 0.87
CPU Time Used for This Analysis: 0.033 Seconds
```

EXAMPLE 4

In Example 4, the desired output is black and white sheets mixed with color simplex and duplex sheets in a stapled condition. Five sets of three sheets are processed in a photocopier with five pitches in the duplex loop and no duplex loop delay. The copier has three pitches in the photoreceptor.

```
Number of Sets = 5
Number of Sheets = 3
Number of Pitches along Duplex Loop = 5, No Duplex Loop Delay
Number of Pitches on PR or TM = 3
Stapled (|); 1 frame needed to staple finished set before outputting new sheet.
Scheduling starts at set 1, sheet 1
```

-continued

```
Developer: Image on Image
Number of Required Pitches for Each Sheet:
Sheet # 1 2 3
Pitches 1 1 1
Number of Passes for Side 1 of Each Sheet(Processing Side Number[COUNT]/Total Side Number):
4( 1/ 1) 4( 2/ 3) 1( 4/ 5)
Number of Passes for Side 2 of Each Sheet(Processing Side Number[COUNT]/Total Side Number):
0( / 2) 4( 3/ 4) 4( 5/ 6)
Pitch Location for each COUNT:
                    1
     1 2 3 4 5 6 7 8 9 0
Frame#12345678901234567890123456789012345678901234567890123456789012345678901234567890123456789012345678901234567890
Set 1:1*21*2132132*35*354*5**5]————————————————————————————————————
Set 2:————————1*21*2132132*35*354*5**5]————————————————————————————
Set 3:————————————————————1*21*2132132*35*354*5**5]————————————————
Set 4:————————————————————————————1*21*2132132*35*354*5**5]————————
Set 5:————————————————————————————————————————1*21*2132132*35*354*5**5
Number of Images per Set: 17
Total Number of Images: 85
Total Number of Frames Used: 100
Productivity: 85/100 = 0.85
CPU Time Used for This Analysis: 0.200 Seconds
```

EXAMPLE 5

In Example 5, the desired output is black and white mixed sheets with color simplex and duplex sheets in a stapled condition after a jammed restart has occurred. Five sets of three sheets are processed in a copier having five pitches in the duplex loop with no duplex loop delay. The copier has three pitches in the photoreceptor. The scheduling starts at set 1, sheet 2, because sheet I of set 1 has exited and the jammed restart begins at sheet 2 of set 1.

```
Number of Sets = 5
Number of Sheets = 3
Number of Pitches along Duplex Loop = 5, No Duplex Loop Delay
Number of Pitches on PR or TM = 3
Stapled (]); 1 frame needed to staple finished set before outputting new sheet.
Scheduling starts at set 1, sheet 1
Developer: Image on Image
Number of Required Pitches for Each Sheet:
Sheet # 1 2 3
Pitches 1 1 1
Number of Passes for Side 1 of Each Sheet(Processing Side Number[COUNT]/Total Side Number):
4( 1/ 1) 4( 2/ 3) 1( 4/ 5)
Number of Passes for Side 2 of Each Sheet(Processing Side Number[COUNT]/Total Side Number):
0( / 2) 4( 3/ 4) 4( 5/ 6)
Pitch Location for each COUNT:
                    1
     1 2 3 4 5 6 7 8 9 0
Frame#12345678901234567890123456789012345678901234567890123456789012345678901234567890123456789012345678901234567890
Set 1:1*21*2132132*35*354*5**5]————————————————————————————————————
Set 2:————————1*21*2132132*35*354*5**5]————————————————————————————
Set 3:————————————————————1*21*2132132*35*354*5**5]————————————————
Set 4:————————————————————————————1*21*2132132*35*354*5**5]————————
Set 5:————————————————————————————————————————1*21*2132132*35*354*5**5
Number of Images per Set: 17
Total Number of Images: 85
Total Number of Frames Used: 100
Productivity: 85/100 = 0.85
CPU Time Used for This Analysis: 0.200 Seconds
```

EXAMPLE 6

In Example 6, the desired output is black and white sheets mixed with color simplex and duplex sheets in a stapled condition. In this example, five sets of three sheets are processed in a copier with five pitches in the duplex loop and having a variable duplex loop delay.

```
Number of Sets = 5
Number of Sheets = 3
Number of Pitches along Duplex Loop = 5, Variable Duplex Loop Delay
Number of Pitches on PR or TM = 3
Stapled (]); 1 frame needed to staple finished set before outputting new sheet.
Scheduling starts at set 1, sheet 1
Developer: Image on Image
Number of Required Pitches for Each Sheet:
Sheet # 1 2 3
Pitches 1 1 1
Number of Passes for Side 1 of Each Sheet(Processing Side Number[COUNT]/Total Side Number):
4( 1/ 1) 4( 2/ 3) 1( 4/ 5)
Number of Passes for Side 2 of Each Sheet(Processing Side Number[COUNT]/Total Side Number):
0( / 2) 4( 3/ 4) 4( 5/ 6)
Pitch Location for each COUNT:
                1
    1 2 3 4 5 6 7 8 9 0
Frame #1234567890123456789012345678901234567890123456789012345678901234567890123456789012345678901234567890
Set 1:2*12*123123153453*5**5]————————————————————————————————————
Set 2:————————2*12*123123153453*5**5]————————————————————————————
Set 3:————————————————2*12*123123153453*5**5]————————————————————
Set 4:————————————————————————————2*12*1231231435*35**5**5]————————————
Set 5:————————————————————————————————2**21*21*2135135435*35]————
Number of Images per Set: 17
Total Number of Images: 85
Total Number of Frames Used: 88
Productivity: 85/88 = 0.97
CPU Time Used for This Analysis: 0.250 Seconds
```

EXAMPLE 7

In Example 7, the desired output includes color duplex sheets, two sets of six sheets are processed in a copier having five pitches in the duplex loop with no duplex loop delay. The copier has three pitches in the photoreceptor.

```
Number of Sets = 2
Number of Sheets = 6
Number of Pitches along Duplex Loop = 5, No Duplex Loop Delay
Number of Pitches on PR or TM = 3
Stapled (]); 1 frame needed to staple finished set before outputting new sheet.
Scheduling starts at set 1, sheet 1
Developer: Image on Image
Number of Required Pitches for Each Sheet;
Sheet # 1 2 3 4 5 6
Pitches 1 1 1 1 1 1
Number of Passes for Side 1 of Each Sheet(Processing Side Number[COUNT]/Total Side Number):
4( 1/ 1) 4( 3/ 3) 4( 5/ 5) 4( 7/ 7) 4( 9/ 9) 4(11/11)
Number of Passes for Side 2 of Each Sheet(Processing Side Number[COUNT]/Total Side Number):
4( 2/ 2) 4( 4/ 4) 4( 6/ 6) 4( 8/ 8) 4(10/10) 4( 12/12)
Legend:
COUNT#: 1 2 3 4 5 6 7 8 9 10 11 12
Symbol: 1 2 3 4 5 6 7 8 9 0 A B
Pitch Location for each COUNT:
                1
    1 2 3 4 5 6 7 8 9 0
Frame #1234567890123456789012345678901234567890123456789012345678901234567890123456789012345678901234567890
Set 1:1**1*21321324324354*5465765768768798*9809A09A0BA0BA*B**B]————————————
Set 2:————————————————————————1**1*21321324324354*5465765768768798*9809A09A0BA0
  1 1 1 1 1 1 1 1 1 2
  1 2 3 4 5 6 7 8 9 0
Frame #1234567890123456789012345678901234567890123456789012345678901234567890123456789012345678901234567890
Set 2:BA*B**B]————————————————————————————————————————————
Number of Images per Set: 48
Total Number of Images: 96
Total Number of Frames Used: 107
Productivity: 96/107 = 0.90
CPU Time Used for This Analysis: 0.250 Seconds
```

EXAMPLE 8

In Example 8, the desired output is black and white sheets with color simplex sheets in a stapled condition. Twenty-five sets of three sheets are processed in a copier having three pitches in the photoreceptor.

```
Number of Sets = 25
Number of Sheets = 3
Number of Pitches on PR or TM = 3
Stapled (|); 1 frame needed to staple finished set before outputting new sheet.
Scheduling starts at set 1, sheet 1
Developer: Image on Image
Number of Required Pitches for Each Sheet:
Sheet # 1 2 3
Pitches 1 1 1
Number of Passes for Side 1 of Each Sheet(Processing Side Number[COUNT]/Total Side Number):
1( 1/ 1) 4( 2/ 3) 1( 3/ 5)
Number of Passes for Side 2 of Each Sheet(Processing Side Number[COUNT]/Total Side Number):
0( / 2) 0( / 4) 0( / 6)
Pitch Location for each COUNT:
                    1
    1 2 3 4 5 6 7 8 9 0
Frame #1234567890123456789012345678901234567890123456789012345678901234567890123456789012345678901234567890
Set 1:2**2**2*12*3]————————————————————————————————————————
Set 2:——2**2**21*23]————————————————————————————————————
Set 3:————2**2**2*12*3]————————————————————————————————
Set 4:——————2**2**21*23]————————————————————————————
Set 5:————————2**2**2*12*3]————————————————————————
Set 6:——————————2**2**21*23]————————————————————
Set 7:————————————2**2**2*12*3]————————————————
Set 8:——————————————2**2**21*23]————————————
Set 9:————————————————2**2**2*12*3]————————
Set 10:——————————————————2**2**21*23]————————
Set 11:————————————————————2**2**2*12*3]————————
Set 12:——————————————————————2**2**21*23]————————
Set 13:————————————————————————2**2**2*12*3]————————
Set 14:——————————————————————————2**2**21*23]————————
Set 15:————————————————————————————2**2**2*12*3]—
Set 16:————————————————————————————2**2**21*
Set 17:————————————————————————————2**2
  1 1 1 1 1 1 1 1 1 2
  1 2 3 4 5 6 7 8 9 0
Frame #1234567890123456789012345678901234567890123456789012345678901234567890123456789012345678901234567890
Set 16:23]————————————————————————————————————————
Set 17:**2*12*3]————————————————————————————————
Set 18:—2**2**21*23]————————————————————————————————
Set 19:——2**2**2*12*3]————————————————————————————
Set 20:————2**2**21*23]————————————————————————————
Set 21:——————2**2**2*12*3]————————————————————————
Set 22:————————2**2**21*23]————————————————————————
Set 23:——————————2**2**2*12*3]————————————————————
Set 24:————————————2**2**21*23]————————————————
Set 25:——————————————2**2**2*123]————————————
Number of Images per Set: 6
Total Number of Images: 150
Total Number of Frames Used: 155
Productivity: 150/155 = 0.97
CPU Time Used for This Analysis: 0.367 Seconds
```

EXAMPLE 9

In Example 9, the desired output is black and white sheets with color simplex sheets in a stacked condition. Twenty-five sets of three sheets are processed in a copier having three pitches in the photoreceptor.

```
Number of Sets = 25
Number of Sheets = 3
Number of Pitches on PR or TM = 3
Stack, No Stapling Delay.
Scheduling starts at set 1, sheet 1
Developer: Image on Image
Number of Required Pitches for Each Sheet:
Sheet # 1 2 3
Pitches 1 1 1
Number of Passes for Side 1 of Each Sheet(Processing Side Number[COUNT]/Total Side Number):
1( 1/ 1) 4( 2/ 3) 1( 3/ 5)
Number of Passes for Side 2 of Each Sheet(Processing Side Number[COUNT]/Total Side Number):
0( / 2) 0( / 4) 0( / 6)
Pitch Location for each COUNT:
                    1
    1 2 3 4 5 6 7 8 9 0
Frame #1234567890123456789012345678901234567890123456789012345678901234567890123456789012345678901234567890
```

-continued

```
Set 1:2**2**21*23
Set 2:--2**2**2*12*3
Set 3:------2**2**21*23
Set 4:----------2**2**2*12*3
Set 5:--------------2**2**21*23
Set 6:------------------2**2**2*12*3
Set 7:----------------------2**2**21*23
Set 8:--------------------------2**2**2*12*3
Set 9:------------------------------2**2**21*23
Set 10:----------------------------------2**2**2*12*3
Set 11:--------------------------------------2**2**21*23
Set 12:------------------------------------------2**2**2*12*3
Set 13:----------------------------------------------2**2**21*23
Set 14:--------------------------------------------------2**2**2*12*3
Set 15:------------------------------------------------------2**2**21*23
Set 16:----------------------------------------------------------2**2**2*12*
Set 17:--------------------------------------------------------------2**2
  1 1 1 1 1 1 1 1 1 2
  1 2 3 4 5 6 7 8 9 0
Frame #1234567890123456789012345678901234567890123456789012345678901234567890123456789012345678901234567890
Set 16:3
Set 17:**21*23
Set 18:--2**2**2*12*3
Set 19:------2**2**21*23
Set 20:----------2**2**2*12*3
Set 21:--------------2**2**21*23
Set 22:------------------2**2**2*12*3
Set 23:----------------------2**2**21*2**3
Set 24:--------------------------2**2**2*12*3
Set 25:------------------------------2**2**21*23
Number of Images per Set: 6
Total Number of Images: 150
Total Number of Frames Used: 154
Productivity: 150/154 = 0.97
CPU Time Used for This Analysis: 0.383 Seconds
```

Although this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Therefore, various changes may be made to the invention without departing from its true spirit and scope as defined in the following claims.

What is claimed is:

1. A method of scheduling an image processing job in an imaging system that includes at least one imaging device having associated device-related parameters, said job including a plurality of images to be processed by said imaging system, said images having associated image-related parameters, said method comprising the steps of:

detecting criteria of said job;

determining a set of applicable constraints based upon at least one of said criteria, inputs entered into said system and said at least one imaging device, said set of constraints including device-based constraints that are influenced by said device-related parameters, image-based constraints that are influenced by said image-related parameters, and image sequence constraints which express fundamental recording medium handling rules and which are independent of said device-related parameters;

constructing a mathematic model based on said set of constraints to represent the entire image processing job; and scheduling said job such that each of the plurality of images in said job can be processed in accordance with said set of constraints and such that all constraints in said model are satisfied substantially simultaneously.

2. The method of claim 1, wherein said determining said set of applicable constraints includes determining imaging device constraints and image sequence constraints.

3. The method of claim 2, wherein said imaging device has a copy paper path that includes a duplex loop through which copy sheets circulate to a photoreceptor for imaging, and wherein said determining a set of applicable constraints includes determining the number of photoreceptor pitches, each of said photoreceptor pitches being a position for one of said copy sheets.

4. The method of claim 3, further comprising expressing a plurality of said applicable constraints as mathematic relationships.

5. The method of claim 4, wherein said step of detecting includes detecting an image designation for each of said plurality of images, said image designation including a set number i, a page number j, a side number l and a pass number k, and wherein said set number is equal to the desired number of duplicates of an image, said page number is equal to the number of pages in each set, said side number is equal to the number of sides of each page, and said pass number is equal to the number of passes required to process each side.

6. The method of claim 5, wherein in said mathematic relationships, an X-th frame resides by one image of said plurality of images of the i-th set, the j-th sheet, the l-th side and the k-th pass, said X-th frame being algebraically related to each other frame, said step of scheduling comprising determining solutions of simultaneous equations representing said frame to arrange a proper processing sequence for the job.

7. The method of claim 6, wherein said step of scheduling comprises minimizing the number of skipped pitches that are schedule between imaged pitches to conform to the applicable constraints.

8. The method of claim 7, wherein a plurality of the constraints are in linear form and expressed in terms of frames and wherein a plurality of resulting equations are in the form of linear inequality equations, and wherein said scheduling step comprises linearly optimizing the equations.

9. The method of claim 6, wherein said step of scheduling includes outputting an optimized sequence of the frames whereby images are transferred to copy sheets passing a nip of the photoreceptor in the order outputted.

10. The method of claim 9 wherein said applicable constraints include a copy sheet delay feature in the duplex loop, said method further comprising specifying by means of said copy sheet delay feature an interval between the processing of the first side of a copy sheet that travels through the duplex loop and the second side of the sheet, said interval being equal to the number of frames that separate said first side from said second side.

11. The method of claim 9 wherein said applicable constraints include a copy sheet delay feature at the end of an invertor path, said method further comprising specifying by means of said copy sheet delay feature an interval between the processing of the first side of a copy sheet that travels through said duplex loop and the second side of said sheet, said interval being equal to the number of frames that separate said first side from said second side.

12. The method of claim 4, wherein said applicable constraints include at least one nonlinear constraint, and wherein said step of scheduling comprises solving said at least one nonlinear constraint using mathematic operations.

13. The method of claim 12 wherein said at least one nonlinear constraint is a single image constraint, said method further comprising requiring by means of said single image constraint that each of said images occupies a distinct pitch on said photoreceptor.

14. The method of claim 12, further comprising excluding said at least one nonlinear constraint from a set of simultaneous linear equations to be solved substantially simultaneously using mathematical optimization, said at least one nonlinear constraint being solvable by use of a slack variable.

15. The method of claim 12, wherein said at least one nonlinear constraint is included in a set of simultaneous linear equations and wherein said step of scheduling comprises assigning an additional image number to each image in the plurality of images and preventing frames with different image numbers from occupying the same frame, said linear equations being solved by mathematical optimization.

16. The method of claim 12, wherein said step of scheduling comprises solving the linear equations by disregarding said at least one nonlinear constraint, determining which frames had been occupied by more than one image, and reducing such multiple-occupancy frames using mathematic operations until each frame exists in one-to-one relationship with each image.

17. The method of claim 16, wherein said step of scheduling comprises transforming inequality equations into equality equations and adding at least one arbitrary slack variable constant to one of the inequality equations when the inequality equations are transformed into equality equations, and varying the integer value of the slack variable constant so that the number of multiple-occupancy frames is reduced.

18.The method of claim 3, wherein said determining a set of applicable constraints includes determining an enhanced image constraint, said enhanced image constraint requiring that each pass of an enhanced image be imaged on the same copy sheet.

19. The method of claim 3, wherein said determining a set of applicable constraints includes determining a single image constraint, said single image constraint requiring that each of said images occupies a distinct pitch on said photoreceptor.

20. The method of claim 2, wherein a previous duplex sheet enters a duplex loop before a next duplex sheet and said determining a set of applicable constraints includes determining a duplex loop entry order constraint, said duplex loop entry order constraint requiring that said previous duplex sheet exits a duplex loop before said next duplex sheet.

21. The method of claim 1, wherein said determining a set of applicable constraints includes determining a pitch number constraint, said pitch number constraint requiring that said pitch number cannot be less than one.

22. The method of claim 1, wherein said determining a set of applicable constraints includes determining a page sequence constraint, said page sequence constraint requiring that the next pitch number of the last pass of a second page must exceed the previous pitch number of the last pass of a previous page.

23. The method of claim 1, wherein said determining a set of applicable constraints includes determining a set sequence constraint, said set sequence constraint requiring that the last page of a previous set is completed before the first page of a next set.

24. The method of claim 23, further comprising requiring by means of said set sequence constraint that a number of skipped pitches follows the last pass of the last page of said previous set before the first pass of the first page of the next set.

25. The method of claim 1, further comprising expressing a plurality of said applicable constraints as mathematic relationship.

26. A scheduler for scheduling an image processing job in an imaging system that includes at least one imaging device having associated device-related parameters, said job including a plurality of images to be processed by said imaging system, said images having associated image-related parameters, said scheduler comprising:

a determining device that detects criteria of said job and determines a set of constraints based on at least one of said criteria, inputs entered into said system, and said at least one imaging device, said set of constraints including device-based constraints that are influenced by said device-related parameters, image-based constraints that are influenced by said image-related parameters, and image sequence constraints which express fundamental recording medium handling rules and which are independent of said device-related parameters, said determining device further constructing a mathematic model using said set of constraints to represent the entire image processing job and solving said model to maximize a productivity value; and a controller that controls said at least one imaging device to output said job in accordance with the set of constraints determined by said determining device.

27. The scheduler of claim 26, wherein said determining device includes an applicable constraints memory containing applicable constraints that govern at least one of an absolute position and a relative position of said plurality of images to be processed.

28. The scheduler of claim 26, further comprising a user interface to allow said inputs entered into said system to be entered by a user.

29. The scheduler of claim 26, further comprising a synchronizer, said synchronizer having a delay device that synchronizes processing of a next simplex sheet with processing of a previous duplex sheet such that said next simplex sheet does not interfere with said previous duplex sheet.

30. The scheduler of claim 26, wherein said at least one imaging device includes a copy paper path that begins at a copy paper entry point, continues through a photoreceptor, and divides at a branch point into a simplex copy paper path and a duplex copy paper path, said simplex copy paper path extending from said branch point through a set of exit roller to a copy paper exit point, said duplex copy paper path extending from said branch point to an inverter, from said inverter to a duplex loop and from said duplex loop to said set of exit rollers and said copy paper exit point, said synchronizer comprising:

a delay device disposed adjacent to said simplex copy paper path and between said branch point and said copy paper exit point, said delay device selectively decreasing the speed at which a simplex copy sheet travels along said simplex copy paper path such that, if said simplex sheet follows a duplex sheet, said delay device operates to delay said simplex sheet so that said duplex sheet reaches said copy paper path exit point before said simplex sheet.

31. A synchronizer that synchronizes the processing of a mixed simplex/duplex job in an imaging device, said imaging device having a copy paper path that begins at a copy paper entry point, continues through a photoreceptor, and divides at a branch point into a simplex copy paper path and a duplex copy paper path, said simplex copy paper path extending from said branch point through a set of exit rollers to a copy paper exit point, said duplex copy paper path extending from said branch point to an inverter, from said inverter to a duplex loop and from said duplex loop to said set of exit rollers and said copy paper exit point, said synchronizer comprising:

a delay device disposed adjacent to said simplex copy paper path and between said branch point and said copy paper exit point, said delay device selectively decreasing the speed at which a simplex copy sheet travels along said simplex copy paper path such that, if said simplex sheet follows a duplex sheet, said delay device operates to delay said simplex sheet so that said duplex sheet reaches said copy paper path exit point before said simplex sheet.

32. The synchronizer of claim 31, wherein said delay device creates an intercopy gap between a trailing edge of said duplex sheet and a leading edge of said simplex sheet and wherein said intercopy gap is less than the width of said simplex sheet, said width being the distance between said leading edge of said simplex sheet and a trailing edge of said simplex sheet.

33. The synchronizer of claim 31, wherein said delay device comprises a first set of retime rollers, said first set of retime rollers being disposed adjacent to said simplex copy paper path and controlled to rotate at a first retime roller rate in a direction opposite the direction of travel of said simplex page, said first retime roller rate being sufficient to prevent said simplex sheet from the intercepting said duplex sheet.

34. The synchronizer of claim 32, further comprising at least one additional set of retime rollers disposed adjacent said simplex copy paper path and a cooperative relationship with said first pair of retime rollers.

35. The synchronizer of claim 31, wherein said delay device selectively operates to decrease the speed at which said simplex page travels after a first side of said duplex page and before a second side of said duplex page is processed.

36. A scheduler for scheduling an image processing job in an imaging system that includes at least two imaging devices connected to said scheduler, said imaging devices having associated device-related parameters, said job including a plurality of images to be processed in at least one task by said imaging system, said images having associated image-related parameters, said scheduler comprising:

a determining device that detects criteria of said job and determines a set of constraints, based on at least one of said criteria and inputs entered into said imaging system, to maximize a productivity value, said set of constraints including device-based constraints that are influenced by said device-related parameters, image-based constraints that are influenced by said image-related parameters, and image sequence constraints which express fundamental recording medium handling rules and which are independent of said device-related parameters;

a constraint module coupled to said determining device and to each of said at least two imaging devices, said constraint module having a device selector that signals which of said at least two imaging devices are connected within said imaging system; and a controller coupled to said determining device and to said constraint module, said controller controlling said imaging devices to output said job in accordance with said set of constraints determined by said determining device, said controller delegating said at least one task to one of said imaging devices connected within said imaging system.

37. The scheduler of claim 36, wherein said job includes at least two tasks, and wherein said controller delegates each of said at least two tasks to a respective imaging device in accordance with said constraints determined by said determining device.

* * * * *